US007798620B2

(12) United States Patent
Tsukada et al.

(10) Patent No.: US 7,798,620 B2
(45) **Date of Patent: *Sep. 21, 2010**

(54) METHOD OF MANUFACTURING A LIQUID CONTAINER

(75) Inventors: Kenji Tsukada, Nagano-Ken (JP); Munehide Kanaya, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 308 days.

This patent is subject to a terminal disclaimer.

(21) Appl. No.: 11/590,834

(22) Filed: Nov. 1, 2006

(65) Prior Publication Data

US 2007/0103493 A1 May 10, 2007

Related U.S. Application Data

(63) Continuation of application No. 09/881,662, filed on Jun. 15, 2001, now Pat. No. 7,156,506.

(30) Foreign Application Priority Data

Jun. 15, 2000 (JP) ..... 2000-179906
Jul. 28, 2000 (JP) ..... 2000-229434

(51) Int. Cl.
*B41J 2/175* (2006.01)
*B41J 2/195* (2006.01)

(52) U.S. Cl. ..... 347/85; 347/7; 347/86

(58) Field of Classification Search ..... 347/7, 347/19, 85; 141/2, 18; 367/157
See application file for complete search history.

(56) References Cited

U.S. PATENT DOCUMENTS 3,110,890 A 11/1963 Westcott et al.
3,220,258 A 11/1965 Red
3,394,589 A 7/1968 Tomioka
3,703,693 A 11/1972 Levinn
3,832,900 A 9/1974 Ross
3,889,247 A 6/1975 Voll
4,008,612 A 2/1977 Nagaoka et al.

(Continued)

FOREIGN PATENT DOCUMENTS

CN 1274645 A 11/2000

(Continued)

OTHER PUBLICATIONS

Patent Abstracts of Japan for JP 11-020162; published on Jan. 26, 1999; Applicant is Fuji Xerox Co., Ltd.

(Continued)

*Primary Examiner*—Anh T. N. Vo
(74) *Attorney, Agent, or Firm*—Sughrue Mion, PLLC

(57) ABSTRACT

A liquid charging method for charging a liquid container with a liquid, the liquid container being provided with a piezo-electric device for detecting a consumption condition of the liquid in said liquid container, the piezo-electric device being provided with a cavity connecting to an inside of the liquid container, has the steps of: reducing a pressure in the liquid container to a pressure lower than atmospheric pressure; and charging the liquid container with the liquid. The liquid container requiring no complicated seal structure for precisely detecting the consumption condition of a liquid by using the piezo-electric device is charged with a liquid without internally leaving air bubbles.

2 Claims, 16 Drawing Sheets

U.S. PATENT DOCUMENTS 4,107,994 A 8/1978 Sogo
4,196,625 A 4/1980 Kern
4,310,957 A 1/1982 Sachs
4,329,875 A 5/1982 Nolting et al.
4,337,470 A 6/1982 Furukawa
4,403,227 A 9/1983 Bertschy et al.
4,419,242 A 12/1983 Cheng et al.
4,419,677 A 12/1983 Kasugayama et al.
4,479,982 A 10/1984 Nilsson et al.
4,570,482 A 2/1986 Murata et al.
4,594,891 A 6/1986 Benz et al.
4,604,633 A 8/1986 Kimura et al.
4,636,814 A 1/1987 Terasawa
4,677,448 A 6/1987 Mizusawa et al.
4,770,038 A 9/1988 Zuckerwar et al.
4,796,782 A 1/1989 Wales et al.
4,811,595 A 3/1989 Marciniak et al.
4,853,718 A 8/1989 El Hatem et al.
4,935,751 A 6/1990 Hamlin
4,977,413 A 12/1990 Yamanaka et al.
4,984,449 A 1/1991 Caldwell et al.
4,984,457 A 1/1991 Morris
5,035,140 A 7/1991 Daniels et al.
5,068,836 A 11/1991 Steel
5,132,711 A 7/1992 Shinada et al.
5,179,389 A 1/1993 Arai et al.
5,233,369 A 8/1993 Carlotta et al.
5,247,832 A 9/1993 Umezawa et al.
5,264,831 A 11/1993 Pfeiffer
5,315,317 A 5/1994 Terasawa et al.
5,319,973 A 6/1994 Crayton et al.
5,353,631 A 10/1994 Woringer et al.
5,410,518 A 4/1995 Birkett
5,463,377 A 10/1995 Kronberg
5,473,353 A 12/1995 Soucemarianadin et al.
5,506,611 A 4/1996 Ujita et al.
5,524,486 A 6/1996 Hermann
5,583,544 A 12/1996 Stamer et al.
5,586,085 A 12/1996 Lichte
5,610,635 A 3/1997 Murray et al.
5,616,929 A 4/1997 Hara
5,619,238 A 4/1997 Higuma et al.
5,675,367 A 10/1997 Scheffelin et al.
5,689,288 A 11/1997 Wimmer et al.
5,694,156 A 12/1997 Hoisington et al.
5,697,248 A 12/1997 Brown
5,712,667 A 1/1998 Sato
5,737,963 A 4/1998 Eckert et al.
5,747,689 A 5/1998 Hampo et al.
5,774,136 A 6/1998 Barbehenn et al.
5,788,388 A 8/1998 Cowger et al.
5,788,819 A 8/1998 Onishi et al.
5,793,705 A 8/1998 Gazis et al.
5,835,817 A 11/1998 Bullock et al.
5,841,454 A 11/1998 Hall et al.
5,877,997 A 3/1999 Fell
5,900,888 A 5/1999 Kurosawa
5,936,650 A * 8/1999 Ouchida et al. ..... 347/89
5,949,447 A 9/1999 Arai et al.
5,975,102 A 11/1999 Schalk
6,003,966 A 12/1999 Ahn
6,007,190 A 12/1999 Murray et al.
6,012,793 A 1/2000 Haigo
6,012,794 A 1/2000 Nakano et al.
6,024,429 A 2/2000 Coffy et al.
6,044,694 A 4/2000 Anderson et al.
6,050,669 A 4/2000 Yano et al.
6,155,664 A 12/2000 Cook
6,164,744 A 12/2000 Froger et al.
6,254,212 B1 7/2001 Coudray et al.
6,280,590 B1 8/2001 Cheng et al.
6,302,527 B1 10/2001 Walker
6,302,531 B1 10/2001 Usui et al.
6,312,074 B1 11/2001 Walker
6,312,106 B1 11/2001 Walker
6,312,115 B1 11/2001 Hara et al.
6,344,658 B1 2/2002 Nakagawa et al.
6,347,853 B1 2/2002 Kato
6,361,136 B1 3/2002 Watanabe
6,390,590 B1 5/2002 Hansburg
6,416,152 B1 7/2002 Matsuzaki et al.
6,435,638 B1 8/2002 Wilson et al.
6,438,500 B1 8/2002 Froger et al.
6,474,796 B1 * 11/2002 Ishinaga ..... 347/85
6,536,861 B1 3/2003 Usui et al.
6,742,879 B2 * 6/2004 Jones et al. ..... 347/86
6,793,305 B2 9/2004 Tsukada et al.
6,799,820 B1 10/2004 Usui et al.
2002/0012015 A1 1/2002 Tsukada et al.
2002/0015068 A1 2/2002 Tsukada et al.
2002/0015084 A1 2/2002 Tsukada et al.
2002/0105555 A1 8/2002 Tsukada et al.
2002/0135623 A1 9/2002 Tsukada et al.
2003/0043216 A1 3/2003 Usui et al.
2003/0117450 A1 6/2003 Usui et al.
2003/0117451 A1 6/2003 Usui et al.
2003/0140694 A1 7/2003 Usui et al.

FOREIGN PATENT DOCUMENTS

EP 0 553 535 8/1993
EP 0 660 092 6/1995
EP 0 676 624 10/1995
EP 068136 A2 11/1995
EP 068136 A3 11/1995
EP 0 803 364 10/1997
EP 0 803 365 A2 10/1997
EP 0 803 365 A3 10/1997
EP 0 853 236 7/1998
EP 0 853 236 A1 7/1998
EP 0 860 284 A2 8/1998
EP 0 873 873 10/1998
EP 0 881 079 A2 12/1998
EP 0 885 731 A2 12/1998
EP 0 956 964 A2 11/1999
EP 1 088 668 A1 9/2000
EP 1 055 520 A1 11/2000
EP 1 088 668 4/2001
FR 2572519 A1 5/1986
GB 2 304 898 3/1997
JP 56-61421 10/1979
JP 56-039413 A 4/1981
JP 56-039414 A 4/1981
JP 56-053078 A 5/1981
JP 56-61421 10/1981
JP 58-32332 3/1983
JP 58-201027 A 11/1983
JP 58-205820 11/1983
JP 358205820 11/1983
JP 59-52422 4/1984
JP 59-187227 10/1984
JP 60-4820 1/1985
JP 62-95225 5/1987
JP 62-095225 A 5/1987
JP 62-184856 A 8/1987
JP 62-184856 A 9/1987
JP 63247047 10/1988
JP 63-295266 A 12/1988
JP 1-67530 5/1989
JP 1-67530 U 5/1989
JP 1-70128 5/1989
JP 03-036037 A 2/1991
JP 03-067657 A 3/1991
JP 03-169642 A 7/1991

| | | | |
|---|---|---|---|
| JP | 03-210427 | | 9/1991 |
| JP | 03-211907 | A | 9/1991 |
| JP | 03-218847 | A | 9/1991 |
| JP | 04-135862 | A | 5/1992 |
| JP | 04135862 | * | 5/1992 |
| JP | 404135862 | | 5/1992 |
| JP | 04-234670 | A | 8/1992 |
| JP | 5-25325 | | 4/1993 |
| JP | 5-254142 | A | 5/1993 |
| JP | 05-254142 | A | 10/1993 |
| JP | 05-318757 | A | 12/1993 |
| JP | 06-155762 | A | 6/1994 |
| JP | 06-218942 | | 8/1994 |
| JP | 06297726 | | 10/1994 |
| JP | 07-137291 | A | 5/1995 |
| JP | 07137276 | | 5/1995 |
| JP | 08-034123 | A | 2/1996 |
| JP | 10-175312 | A | 12/1996 |
| JP | 09-020013 | A | 1/1997 |
| JP | 09-29989 | A | 2/1997 |
| JP | 09-029991 | A | 2/1997 |
| JP | 09-039263 | A | 2/1997 |
| JP | 9-29989 | A | 4/1997 |
| JP | 09-220216 | A | 8/1997 |
| JP | 09-267488 | A | 10/1997 |
| JP | 09-286121 | A | 11/1997 |
| JP | 10026549 | | 1/1998 |
| JP | 10-038662 | A | 2/1998 |
| JP | 10-151753 | A | 6/1998 |
| JP | 10-305590 | | 11/1998 |
| JP | 10-305590 | A | 11/1998 |
| JP | 10-323993 | A | 12/1998 |
| JP | 10-323997 | A | 12/1998 |
| JP | 11-010909 | A | 1/1999 |
| JP | 11-020188 | A | 1/1999 |
| JP | 11-048490 | A | 2/1999 |
| JP | 11-277760 | A | 10/1999 |
| JP | 11-286121 | A | 10/1999 |
| JP | 11-334107 | A | 12/1999 |
| JP | 2000-190523 | A | 1/2000 |
| JP | 2000-043287 | A | 2/2000 |
| JP | 2000-318183 | A | 11/2000 |
| JP | 2000318183 | | 11/2000 |
| JP | 2001-146030 | A | 5/2001 |
| WO | WO 98/09139 | | 3/1998 |
| WO | WO 98/31548 | | 7/1998 |
| WO | WO 99/42293 | | 8/1999 |

OTHER PUBLICATIONS

Partial English-language translation of JP 58-205820.
U.S. Appl. No. 09/574,015, filed May 19, 2000, Usui et al.
US 5,635,961, 06/1997, Sato (withdrawn)

* cited by examiner

METHOD OF MANUFACTURING A LIQUID CONTAINER

This is a continuation of application Ser. No. 09/881,662 filed Jun. 15, 2001 now U.S. Pat. No. 7,156,506. The entire disclosure of the prior application, application Ser. No. 09/881,662 is considered part of the disclosure of the accompanying continuation application and is hereby incorporated by reference.

BACKGROUND OF THE INVENTION

1. Field of the Invention

The present invention relates to a liquid container having a piezo-electric device for detecting the consumption condition of a liquid in the liquid container by detecting changes in the acoustic impedance in the medium and particularly detecting changes in the resonance frequency, and a method for charging the liquid container with a liquid. Typically, the liquid container is an ink cartridge used for an ink jet recording apparatus which pressurizes ink in a pressure generation chamber in accordance with print data by a pressure generation means and injects ink drops from a nozzle opening for printing.

2. Description of the Related Art

As an example of a conventional liquid container, an ink cartridge mounted to an ink jet recording apparatus will be explained. An ink jet recording apparatus generally has a pressure generation means for pressurizing a pressure generation chamber, a carriage with an ink jet recording head having a nozzle opening for injecting pressurized ink from the ink nozzle opening as ink drops, and an ink tank for containing ink to be fed to the recording head via a flow path and is structured so as to permit continuous printing. The ink tank is generally structured as a cartridge removable from the recording apparatus so as to be simply exchanged by a user when ink is exhausted.

Further, to control ink consumption of the ink cartridge, there is a method for calculating the count of ink drops injected by the recording head and the ink amount sucked at the maintenance step of the recording head by the software and controlling ink consumption by calculation. Moreover, there is a method for attaching two electrodes for direct liquid level detection to the ink cartridge, thereby detecting the point of time when ink is actually consumed by a predetermined amount, and controlling ink consumption.

However, in the method for calculating the injection count of ink drops and the ink amount sucked by the software and controlling the ink consumption by calculation, an innegligible error is caused between the ink consumption amount by calculation and the actual consumption amount. Further, when the cartridge is removed once and then mounted again, the calculated count is reset once, so that the actual residual volume of ink cannot be found at all.

Further, in the method for controlling the point of time of ink consumption by the electrodes, the liquid-tight structure between the electrodes and the ink cartridge is complicated. Further, as a material of the electrodes, a noble metal which is highly conductive and corrosion-resistant is generally used, so that the manufacturing cost of an ink cartridge is increased. Further, the two electrodes must be mounted at separate positions respectively, so that the manufacturing steps are increased.

On the other hand, a method for detecting changes in the acoustic impedance using a piezo-electric device, thereby detecting the consumption condition of a liquid in a liquid container is proposed. By this method, the aforementioned problems are eliminated.

According to this method, the ink cartridge is mounted so that the piezo-electric device for detecting the residual quantity of ink in the cartridge comes in contact with ink in the ink cartridge.

Meanwhile, when air remains in the ink cartridge when ink is charged in the ink cartridge, a problem of defective injection of the recording head arises. However, it is not easy due to a complicated structure of the piezo-electric device to charge ink in every part in the ink cartridge free of residual air. Further, to precisely detect the consumption condition of ink in the ink cartridge by the piezo-electric device, before the ink cartridge is used first or before it is reused, it is necessary to charge the ink cartridge with ink so that ink comes in contact with the piezo-electric device. For example, in the state that the ink cartridge is charged with ink fully, when ink does not come in contact with the face of the piezo-electric device which is to come in contact with a liquid for the reason of that air bubbles remain on the face of the piezo-electric device which is to come in contact with a liquid, although the ink cartridge is fully charged with ink, the piezo-electric device detects by mistake that the ink cartridge is not charged with ink fully.

Further, recharging the used ink cartridge with ink is more difficult than charging a new ink cartridge with ink. In the used ink cartridge, ink is adhered to the part in the neighborhood of the ink feed port where fine slits and holes exist while in use and air may be shut in the slits and holes. When the ink in the ink cartridge is exhausted in this state and the ink cartridge is withdrawn, at the time of recharging the ink cartridge with ink, it is difficult to charge the slits and holes, where ink is adhered and air is shut in, with ink.

Further, in the method for detecting changes in the acoustic impedance by the piezo-electric device, thereby detecting the consumption condition of the liquid in the liquid container, the piezo-electric device is structured so as to be in contact with ink in order to detect the ink level. Therefore, if ink is consumed and the ink level is lowered below the mounting position of the piezo-electric device, when ink is adhered to the piezo-electric device by mistake due to vibration and/or swing, although there is no ink under normal state, there is a risk that the piezo-electric device may detect by mistake that there is ink. Even when ink drops are adhered to the inner wall of the ink cartridge, and the ink drops fall, and ink is adhered to the piezo-electric device, there is a possibility that the same maldetection may be caused.

Further, in a conventional ink cartridge, ink is adhered to the inner wall of the ink cartridge and the flow path, thereby ink remains, and the ink in the ink cartridge may not be used fully. The ink remaining in the ink cartridge is in contact with air for a long period of time, thus it is reduced in quality and solidified with foreign substances. When such an ink cartridge is recharged with new ink, there is the possibility that ink of poor quality and foreign substances coexist and the ink quality is reduced.

Furthermore, when a conventional ink cartridge is to be recycled, it should be fully cleaned internally. Particularly when an ink cartridge having an inner flow path in a complicated shape is to be recycled, a problem arises that the cleaning requires a lot of time and the cost is increased.

Recently, the environmental problem is a great social problem and it is very desired to provide an ink cartridge which can be easily recycled.

SUMMARY OF THE INVENTION

The present invention was developed with the foregoing in view and is intended to provide a method for charging a liquid container, typically an ink cartridge, with a liquid without leaving air bubbles in the liquid container that is able to precisely detect the consumption condition of a liquid by in the liquid container using a piezo-electric device and requires no complicated seal structure. The present invention is also intended to provide a liquid container in which a liquid is charged by the above mentioned liquid charging method and a method for manufacturing the same.

According to the first aspect of the present invention, a liquid charging method for charging a liquid container with a liquid, said liquid container being provided with a piezo-electric device for detecting a consumption condition of said liquid, said piezo-electric device being provided with cavity connecting to an inside of said liquid container, comprises the steps of: reducing a pressure in said liquid container to a pressure lower than atmospheric pressure; and charging said liquid container with said liquid.

Preferably, said pressure reducing step and said liquid charging step are executed in a pressure reducing container.

Preferably, said pressure reducing step includes sucking and removing an air in said liquid container via an opening formed in said liquid container so as to reduce said pressure in said liquid container, and said liquid charging step includes charging said liquid container with said liquid via said opening.

Preferably, said pressure reducing step includes, under a state that a first opening formed in said liquid container is closed, sucking and removing an air in said liquid container via a second opening formed in said liquid container, and said liquid charging step includes closing said second opening and opening said first opening, and charging said liquid container with said liquid via said first opening.

Preferably, the liquid charging method further comprises a step of, at the time of ending of liquid charging into said liquid container, sucking and ejecting a predetermined amount of said liquid from said liquid container.

Preferably, said pressure reducing step and said liquid charging step are executed almost at the same time.

Preferably, a flow rate of an air to be sucked from said liquid container is larger than a flow rate of said liquid to be charged in said liquid container.

Preferably, said liquid charging step is executed while keeping said liquid container warm.

Preferably, said liquid container has a first liquid containing chamber connecting to an atmospheric air and a second liquid containing chamber connecting to said first liquid containing chamber and provided with said piezo-electric device, said first and second liquid containing chambers being formed by dividing said inside of said liquid container with at least one partition formed in said inside of said liquid container, and said first and second liquid containing chambers are charged with said liquid respectively by said pressure reducing step and said liquid charging step.

Preferably, in said liquid charging step, said liquid is charged via an opening formed at a predetermined position in said second liquid containing chamber and then said first liquid containing chamber is charged with said liquid.

Preferably, in said liquid charging step, said first liquid containing chamber is charged with said liquid and then said second liquid containing chamber is charged with said liquid.

Preferably, said liquid container is a used liquid container.

Preferably, said liquid container has a lyophobic part therein which is lyophobic to said liquid in said liquid container.

According to the second aspect of the present invention, a liquid container comprises: a container body; and a piezo-electric device for detecting a consumption condition of a liquid in said container body, said piezo-electric device being provided with a cavity connecting to said container body. Said container body is charged with a liquid by a liquid charging method including a step of reducing a pressure in said container body to a pressure lower than atmospheric pressure and a step of charging said container body with said liquid.

Preferably, said liquid is ink for an ink jet recording apparatus, and said liquid container can be mounted to said ink jet recording apparatus in a removable state.

Preferably, said liquid container has a lyophobic part therein which is lyophobic to said liquid in said liquid container.

Preferably, said piezo-electric device has a vibration area which is in contact with said liquid in said container body, said vibration area being lyophobic to said liquid.

Preferably, said lyophobic part includes an inner side of said cavity.

The piezo-electric device may have a substrate for mounting a piezo-electric material to the container body. In this case, the lyophobic part preferably includes the part of the substrate in contact with a liquid in the container body. The lyophobic part may include amounting structure for mounting the piezo-electric device to the container body. The lyophobic part may be the whole part of the liquid container in contact with a liquid in the container body. The contact angle between the lyophobic part and the liquid in the container body is preferably about 70 degrees or more.

In the liquid container of the present invention, at least the periphery of the lyophobic part may be lyophilic to a liquid in the container body. The contact angle between the lyophobic part and the liquid in the container body is preferably about 70 degrees or more and the contact angle between the lyophilic part and the liquid in the container body is preferably about 30 degrees or less.

The lyophobic part is preferably formed by covering it with a material lyophobic to a liquid in the container body. The lyophobic part may be covered with fluoride as a material lyophobic to a liquid. The lyophobic part may be formed from a material lyophobic to a liquid in the container body. The lyophobic part may be formed from polytetrafluoroethylene resin as a material lyophobic to a liquid. The lyophobic part may be formed by performing a roughening process for a predetermined material.

The piezo-electric device attached to the liquid container of the present invention preferably detects at least acoustic impedance of a medium in the container body and detects the consumption condition of the liquid on the basis of changes in the acoustic impedance. The piezoelectric device preferably has a vibration part and detects the consumption condition of the liquid on the basis of counter electromotive force generated by the residual vibration remaining in the vibration part.

According to the third aspect of the present invention, a method for manufacturing a liquid container comprises the steps of: preparing a liquid container having a container body for containing a liquid and a liquid feed port for feeding said liquid in said container body to an outside, and a piezo-electric device for detecting a consumption condition of said liquid in said container body, said piezo-electric device being provided with a cavity connecting to an inside of said container body; forming a lyophobic part in said piezo-electric device, said lyophobic part being lyophobic to said liquid in said container body; attaching said piezo-electric device to said liquid container; and charging said container body with said liquid using a liquid charging method, said liquid charging method comprising a step of reducing a pressure in said container body to a pressure lower than atmospheric pressure and a step of charging said container body with said liquid.

Preferably, said attaching step is executed after said forming step is executed.

Preferably, said forming step is executed after said attaching step is executed.

Preferably, said preparation step prepares an attaching structure for attaching said piezo-electric device to said liquid container together with said liquid container and said piezo-electric device. Said manufacturing method further comprises a step of mounting said piezo-electric device to said attaching structure. Said piezo-electric device is attached to said liquid container when said attaching structure is attached to said liquid container in said attaching step after said mounting step.

Preferably, said forming step is executed after said mounting step is executed.

Preferably, said forming step is executed after said mounting step and said attaching step are executed.

Preferably, said mounting step is executed after said forming step is executed.

The forming step preferably covers the lyophobic part with a material lyophobic to the liquid in the container body. For example, the lyophobic part may be immersed in a material lyophobic to the liquid in the container body beforehand so as to cover the lyophobic part with it. Further, the lyophobic part may be coated with a material lyophobic to the liquid in the container body so as to cover the lyophobic part with it. Further, the lyophobic part may be attached with a coating layer lyophobic to the liquid in the container body so as to cover the lyophobic part with it. Further, the lyophobic part may be deposited with a material lyophobic to the liquid in the container body so as to cover the lyophobic part with it. Further, the lyophobic part may be plated with a material lyophobic to the liquid in the container body so as to cover the lyophobic part with the material lyophobic to the liquid in the container body.

Further, the forming step may form a lyophobic part by irradiating ultraviolet rays on a predetermined material. Furthermore, the forming step may form a lyophobic part by performing a roughening process for a predetermined material.

DETAILED DESCRIPTION OF THE PREFERRED EMBODIMENTS

The present invention will be explained in detail hereunder using the embodiments thereof.

With respect to detection of the liquid condition in the liquid container using a concrete vibration phenomenon, several methods may be considered. For example, there is a method for generating an elastic wave inside the liquid container by an elastic wave generation means, receiving a reflected wave reflected by the liquid surface or the opposite wall, thereby detecting a medium and condition changes thereof in the liquid container. Separately from it, there is another method for detecting changes in the acoustic impedance from the vibration characteristics of a vibrating object. As a method using changes in the acoustic impedance, there are a method for vibrating the vibration part of an actuator which is a piezoelectric device having a piezo-electric element, thereafter, measuring counter electromotive force generated by the residual vibration remaining in the vibration part, thereby detecting the resonance frequency or the amplitude of counter electromotive force waveform and detecting changes in the acoustic impedance. Moreover, there is a method for measuring the impedance characteristics or admittance characteristics of a liquid by a measuring instrument, for example, an impedance analyzer of the transmission circuit and measuring changes in the current and voltage or changes in the current and voltage by the frequency when vibration is given to the liquid.

The present invention provides a method for charging a liquid container having a mounted piezo-electric device (actuator) used for a method for at least detecting changes in the acoustic impedance and detecting the consumption condition of a liquid in the liquid container with a liquid and the liquid container charged with the liquid by this method.

Figure 1:
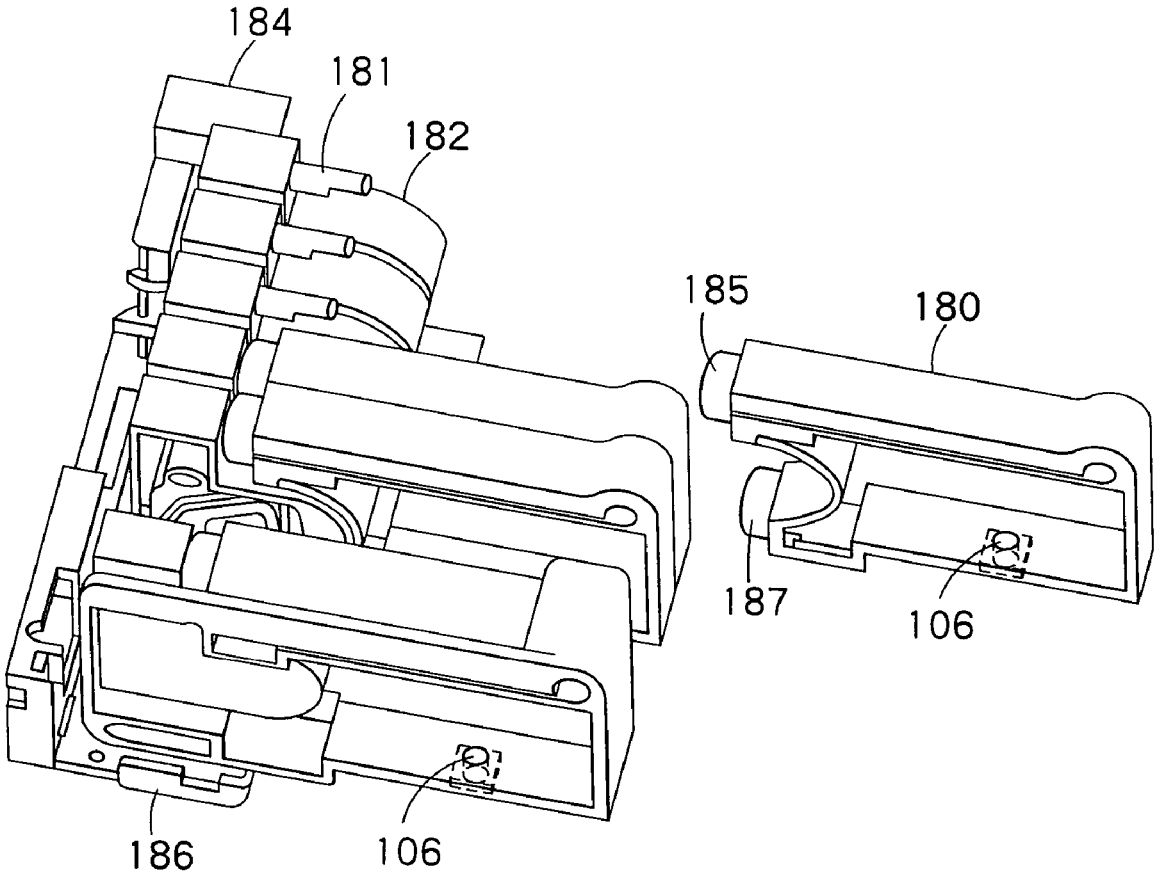
FIG. 1 is a perspective view showing ink cartridges which are an embodiment of a liquid container of the present invention and the essential section of an ink jet recording apparatus where the ink cartridges are mounted.

FIG. 1 shows ink cartridges and an ink jet recording apparatus. A plurality of ink cartridges 180 are mounted in the ink jet recording apparatus having a plurality of ink inlets and head plates 186 corresponding to the respective ink cartridges 180. The plurality of ink cartridges 180 contain different kinds, for example, colors of ink respectively. On the respective bottoms of the plurality of ink cartridges 180, actuators 106 which are means for at least detecting the acoustic impedance are mounted. Since the actuators 106 are mounted in the ink cartridges 180, the residual quantity of ink in the ink cartridges 180 can be detected.

The ink jet recording apparatus has the ink inlets 182, a holder 184, and the recording head 186. Ink is jetted from the recording head 186 and the recording operation is executed. The ink inlets 182 have air feed ports 181 and ink introduction ports not shown in the drawing. The air feed ports 181 feed air to the ink cartridges 180. The ink inlets introduce ink from the ink cartridges 180 into the recording head 186. The ink cartridges 180 have air inlets 185 and ink feed ports 187. The air inlets 185 introduce air from the air feed ports 181 of the ink inlets 182. The ink feed ports 187 feed ink to the ink introduction ports of the ink inlets 182. When the ink cartridges 180 introduce air from the air inlets 185, the ink cartridges 180 prompt feed of ink to the ink jet recording apparatus. The holders 184 connect ink fed from the ink cartridges 180 via the ink inlets 182 to the head plates 186.

Figure 2C:
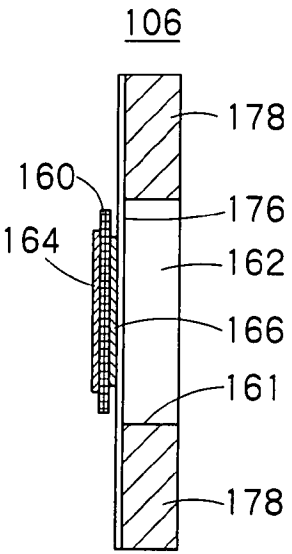
FIGS. 2A, 2B and 2C are drawings each showing an actuator mounted in the ink cartridge shown in FIG. 1 in detail.
Figure 2A:
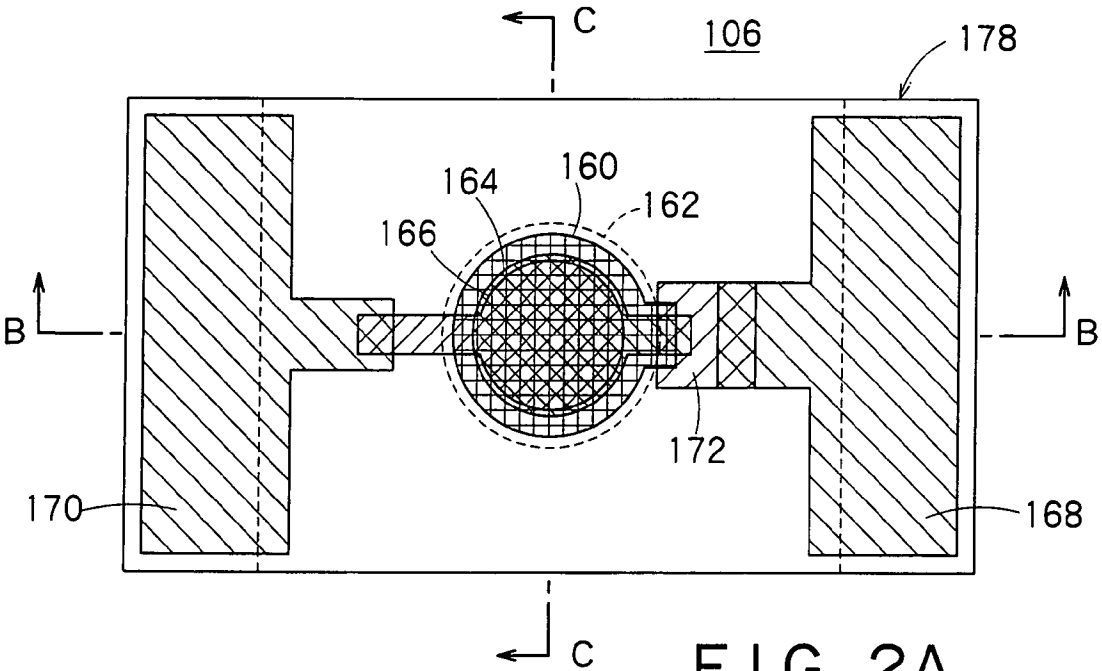
Figure 2B:
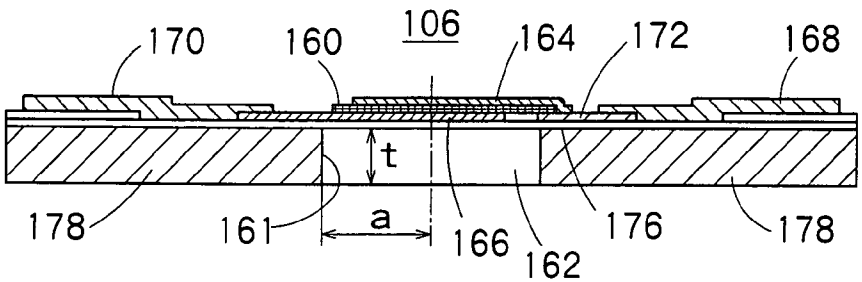

FIG. 2A, FIG. 2B and FIG. 2C show the details of the actuator 106 which is one example of a piezoelectric device. An actuator referred to herein is employed in a method of detecting at least the change of acoustic impedance and detecting a consumption state of a liquid within the liquid container. Particularly, it is employed in a method of detecting at least the change of acoustic impedance by detecting resonance frequency from the remaining oscillation and detecting a consumption state of a liquid within the liquid container. FIG. 2A is an enlarged plan view of the actuator 106. FIG. 2B shows a section taken along the line B-B in FIG. 2A. FIG. 2C shows a section taken along the line C-C in FIG. 2A.

The actuator 106 has a substrate 178 having a circular opening 161 at approximate center of it, an oscillation plate 176 arranged on one of the faces (hereinafter, referred to as "surface") of the substrate 178 so as to cover the opening 161, a piezoelectric layer arranged on the side of the surface of the oscillation plate 176, an upper portion electrode 164 and a lower portion electrode 166 sandwiching the piezoelectric layer 160 from the both sides, an upper portion electrode terminal 168 for electrically coupling to the upper portion electrode 164, a lower portion electrode terminal 170 for electrically coupling to the lower portion electrode 166, and an auxiliary electrode 172 provided and arranged between the upper portion electrode 164 and the upper portion electrode terminal 168 and electrically coupling both of these. The piezoelectric layer 160, the upper portion electrode 164 and the lower portion electrode 166 have a circular portion as a major portion, respectively. The respective circular portions of the piezoelectric layer 160, the upper portion electrode 164 and the lower portion electrode 166 forms the piezoelectric elements.

The oscillation plate 176 is formed so as to cover the opening 161 on the surface of the substrate 178. The cavity 162 is formed by the portion facing the opening 161 of the oscillation plate 176 and the opening 161 of the surface of the substrate 178. The face of the contrary side (hereinafter, referred to as "reverse face") of a piezoelectric element of the substrate 178 faces the liquid container side, the cavity 162 is configured so that the cavity 162 contacts with a liquid. The oscillation plate 176 is mounted with respect to the substrate 178 in a fluid-tight manner so that even if a liquid enters within the cavity 162, the liquid does not leak to the surface side of the substrate 178.

The lower portion electrode 166 is located on the surface of the oscillation plate 176, that is to say, on the face of the contrary side of the liquid container, and it is mounted so that the center of the circular portion which is the major portion of the lower portion electrode 166 and the center of the opening 161 are approximately consistent with each other. It should be noted it is set so that an area of the circular portion of the lower portion electrode 166 is smaller than that of the opening 161. On the other hand, on the surface side of the lower portion electrode 166, the piezoelectric layer 160 is formed so that the center of its circular portion and the center of the opening 161 are approximately consistent with each other. It is set so that an area of the circular portion of the piezoelectric layer 160 is smaller than that of the opening 161 and larger than that of the circular portion of the lower portion electrode 166. On the other hand, on the surface side of the piezoelectric layer 160, the upper portion electrode 164 is formed so that the center of the circular portion which is the major portion of it and the center of the opening 161 are approximately consistent with each other. It is set so that an area of the circular portion of the upper portion electrode 164 is smaller than those of the circular portion of the opening 161 and the piezoelectric layer 160 and larger than that of the circular portion of the lower portion electrode 166.

Therefore, the major portion of the piezoelectric layer 160 has a structure so that the major portion of it is sandwiched from the front face side and back face side by the major portion of the upper portion electrode 164 and the major portion of the lower portion electrode 166, respectively, and the piezoelectric layer 160 can be effectively deformed and driven. The circular portions which are the major portions of the piezoelectric layer 160, the upper portion electrode 164 and the lower portion electrode 166, respectively, form piezoelectric elements in the actuator 106. As described above, the piezoelectric element contacts with the oscillation plate 176. Moreover, the largest area is the area of the opening 161 among the circular portion of the upper portion electrode 164, the circular portion of the piezoelectric layer 160, the circular portion of the lower portion electrode 166 and the opening 161. Owing to this structure, the actually oscillating region out of the oscillation plate 176 is determined by the opening 161. Moreover, since the circular portion of the upper portion electrode 164, the piezoelectric layer 160 and the circular portion of the lower portion electrode 166 are smaller than that of the opening 161, the oscillation plate 176 is more easily oscillating. Moreover, when comparing the circular portion of the upper portion electrode 164 and the circular portion of the lower portion electrode 166 both connecting with the piezoelectric layer 160, the circular portion of the lower portion electrode 166 is smaller. Therefore, the circular portion of the lower portion electrode 166 determines the portion of the piezoelectric layer 160 where the piezoelectric effect is generated. The upper portion electrode terminal 168 is formed on the front face of the oscillation plate 176 so that it electrically connects with the upper portion electrode 164 via the auxiliary electrode 172. On the other hand, the lower portion electrode terminal 170 is formed on the front face side of the oscillation plate 176 so that it electrically connects with the lower portion electrode 166.

It should be noted that the piezoelectric element and the oscillating region directly facing the piezoelectric element out of the oscillating plate 176 are the oscillating section for actually oscillating in the actuator 106. Moreover, it is preferable that members contained in the actuator 106 is integrally formed by burning each other. The treatment of the actuator 106 becomes easier by integrally forming the actuator 106. Furthermore, the oscillating property is enhanced by enhancing the strength of the substrate 178. Specifically, by enhancing the strength of the substrate 178, only the oscillating section of the actuator 106 vibrates and portions except for the oscillating section do not vibrate. Moreover, the purpose for making the portions except for the oscillating section of the actuator 106 not vibrate can be achieved by making the piezoelectric element of the actuator 106 thinner and smaller and the oscillation plate 176 thinner in the contrast to by enhancing the strength of the substrate 178.

The upper portion electrode 164 is formed on the front face side of the piezoelectric layer 160, on the way of connecting with the upper portion electrode terminal 168. It is necessary to have a step difference equivalent to the sum of the thickness of the piezoelectric layer 160 and the thickness of the lower portion electrode 166. It is difficult to form this step difference only by the upper portion electrode 164, if it is possible, the connection state between the upper portion electrode 164 and the upper portion electrode terminal 168 becomes fragile, there may be a risk to be cut. Therefore, the upper portion electrode 164 and the upper portion electrode terminal 168 are connected by employing the auxiliary electrode 172 as an auxiliary member. By dealing with it in such a manner, it becomes a structure that the piezoelectric layer 160 as well as the upper portion electrode 164 is supported by the auxiliary electrode 172, the desired mechanical strength can be obtained, and the connection between the upper portion electrode 164 and the upper portion electrode terminal 168 is capable of being secured.

As a material for the piezoelectric layer 160, it is preferable to employ lead zirconate titanate (PZT), lead lanthanum zirconate titanate (PLZT) or lead less piezoelectric film in which lead is not used, and as a material for the substrate 178, it is preferable to employ zirconia or alumina. Moreover, for the oscillation plate 176, it is preferable to employ the same material with the substrate 178. For the upper portion electrode 164, the lower portion electrode 166, the upper portion electrode terminal 168 and the lower portion electrode terminal 170, a material having electrical conductivity, for example, a metal such as gold, silver, copper, platinum, aluminum, nickel and the like can be employed.

The actuator 106 constituted as described above can be applied to a container for containing a liquid. For example, the actuator can be mounted on an ink cartridge and an ink tank, or a container containing a washing solvent for solving a recording head and the like.

The actuator 106 shown in FIG. 2A, FIG. 2B and FIG. 2C is mounted in the predetermined position on the liquid container so that the cavity 162 is contacted with a liquid contained within the liquid container. In the case where the liquid is sufficiently contained within the liquid container, the interior of the cavity 162 and outside of it is filled with the liquid. On the other hand, when the liquid within the liquid container is consumed and the liquid level is lowered to the point lower than the mounting position of the actuator, a state where either the liquid does not exist within the cavity 162 or the liquid remains only within the cavity 162 and gas exists its outside appears. The actuator 106 detects at least difference of acoustic impedance occurred by this change of a state. Owing to this, the actuator 106 can detect whether or not it is a state where a liquid is sufficiently contained within the liquid container or more than certain volume of the liquid is consumed. Furthermore, the actuator 106 is capable of detecting a kind of the ink within the liquid container.

When the liquid container is the ink cartridge 180 and the actuator 106 shown in FIGS. 2A, 2B and 2C is mounted to the ink cartridge 180, a cavity 162 is positioned in a predetermined location of the ink cartridge 180 so as to be in contact with ink contained in the ink cartridge 180. When ink is contained fully in the ink cartridge 180, the inside and outside of the cavity 162 are full of ink. On the other hand, when the ink in the ink cartridge 180 is consumed and the ink level lowers down to the mounting position of the actuator, a state that no liquid exists in the cavity 162 or a liquid remains only in the cavity 162 and air exists outside it appears. The actuator 106 detects at least a difference in the acoustic impedance caused by changes in this state. Thereby, the actuator 106 can detect whether ink is fully contained in the ink cartridge 180 or a fixed amount of ink or more is consumed.

To precisely detect the consumption condition of ink in the ink cartridge 180 by the actuator 106, in the state before the ink cartridge 180 is used first or before it is reused, it is necessary to charge the ink cartridge 180 with ink so that ink is charged in the cavity 162 of the actuator 106. The reason for that the cavity 162 is not charged with ink will be explained below.

Figure 3A:
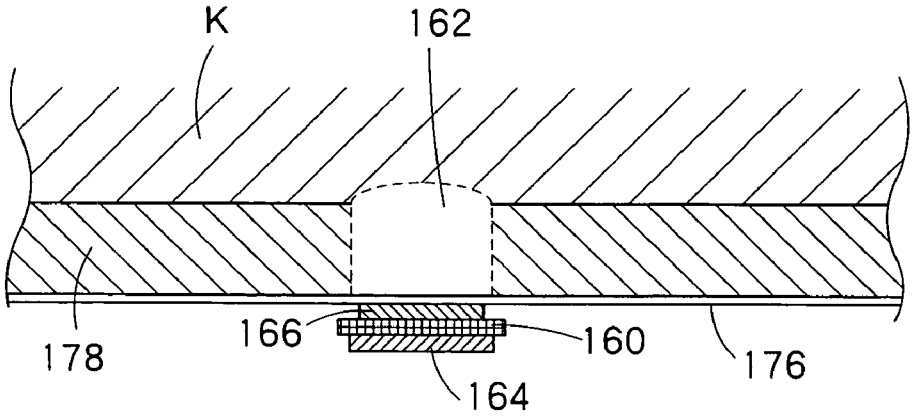
FIGS. 3A, 3B and 3C are sectional views each showing the part of the cavity of the actuator, which is enlarged, when the ink cartridge shown in FIG. 1 is charged with ink fully.
Figure 3B:
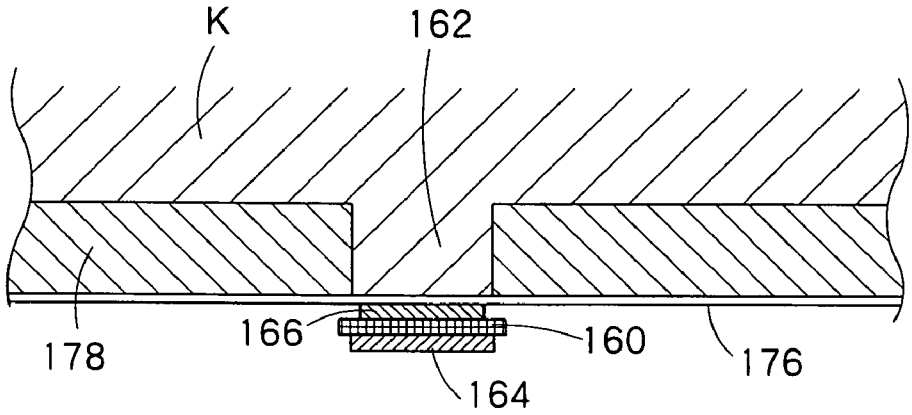
Figure 3C:
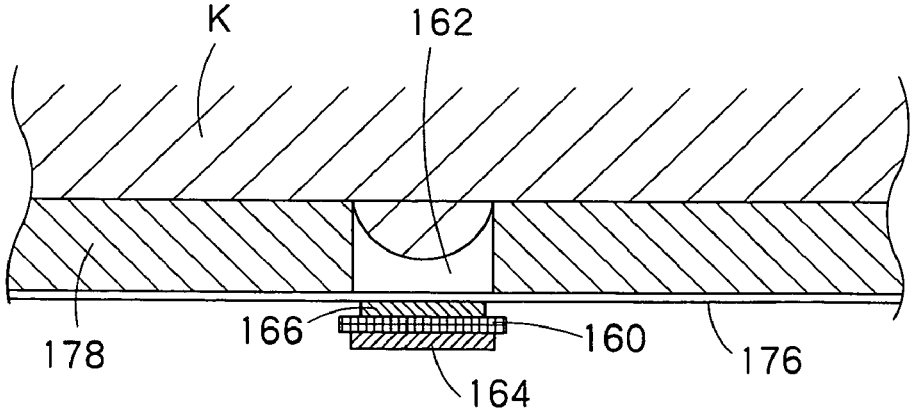

FIGS. 3A, 3B and 3C are sectional views showing the part of the cavity 162 of the actuator 106, which is enlarged, when the ink cartridge 180 is charged with ink fully. FIG. 3A shows a state that ink K is not charged in the cavity 162 because air bubbles remain in the cavity 162. On the other hand, FIG. 3B shows a state that the cavity 162 is charged with ink K. When the diameter of the cavity 162 is 0.5 mm or less, ink is hardly charged in the natural state because the diameter of the cavity 162 is small. Therefore, even if the ink cartridge is charged with ink fully, as shown in FIG. 3A, air remains in the cavity 162 and ink is not charged. On the other hand, even if the diameter of the cavity 162 is larger than 0.5 mm, when air bubbles remain in the corners of the cavity 162, the air bubbles are hardly removed, so that the cavity cannot be charged with ink.

On the other hand, when the diameter of the cavity 162 is small, capillary force is acted on the narrow gap formed by the cavity 162. As a result, the air pressure remaining in the cavity 162 is balanced with the capillary force and a phenomenon that the cavity 162 is not full of ink appears. When it is intended to apply pressure to ink K and press ink K into the cavity 162 when the air pressure remaining in the cavity 162 is balanced with the capillary force, as shown in FIG. 3C, the contact angle at the contact part of ink K and the cavity 162 is larger than the static contact angle and force is acted in the direction of pressing out ink K from the cavity 162. Therefore, to apply pressure to ink K and charge the cavity 162 having residual air bubbles with ink, it is necessary to apply large pressure enough to crush air bubbles in the cavity 162 to ink K.

In this embodiment, at the time of removing residual air bubbles from the cavity 162 and charging the cavity 162 with ink, air is sucked and removed from the ink cartridge 180 and the ink cartridge 180 is decompressed. When the ink cartridge 180 is decompressed, air bubbles can be removed easily from the cavity 162 and the cavity 162 can be charged with ink as shown in FIG. 3B.

Figure 4:
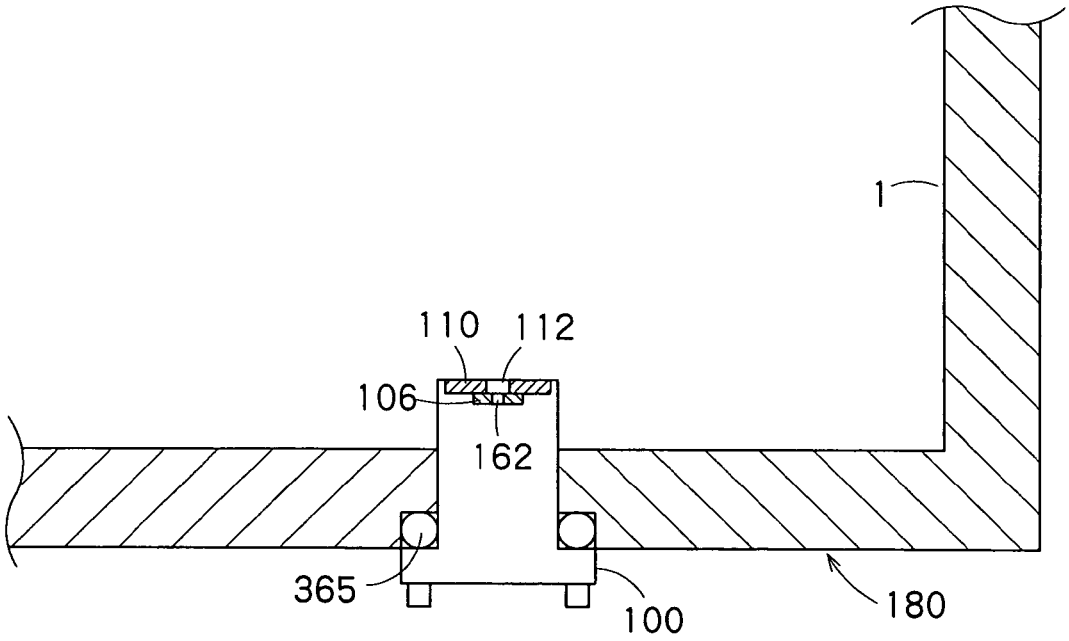
FIG. 4 is a sectional view in the neighborhood of the bottom of the container body when the module body that the actuator shown in FIGS. 2A, 2B and 2C is installed at the end is mounted to the ink cartridge.

FIG. 4 is a sectional view in the neighborhood of the bottom of a container body 1 when a module body 100 that the actuator 106 shown in FIGS. 2A, 2B and 2C is installed at the end is mounted to the ink cartridge 180. The module body 100 is mounted so as to pass through the wall of a container body 1. At the junction of the wall of the container body 1 and the module body 100, an O-ring 365 is installed and keeps the liquid tightness between the module body 100 and the container body 1. It is preferable that the module body 100 has a cylindrical part so as to seal with the O-ring 365.

When the end of the module body 100 is inserted into the container body 1, ink in the container body 1 is in contact with the actuator 106 via a through hole 112 of a plate 110. The resonance frequency of the residual vibration of the actuator 106 varies with whether the circumference of the vibration part of the actuator 106 is a liquid or air, so that the consumption condition of ink can be detected using the module body 100.

As shown in FIG. 4, the size of the cavity 162 of the actuator 106 is smaller than the size of the ink cartridge 180 and the module 100 and the diameter is 1.0 mm or less. Therefore, as shown in FIG. 3A, at the time of charging the ink cartridge 180 with ink, it is difficult by the ordinary charging method to charge the cavity 162 with ink without remaining air bubbles in the cavity 162.

Figure 5:
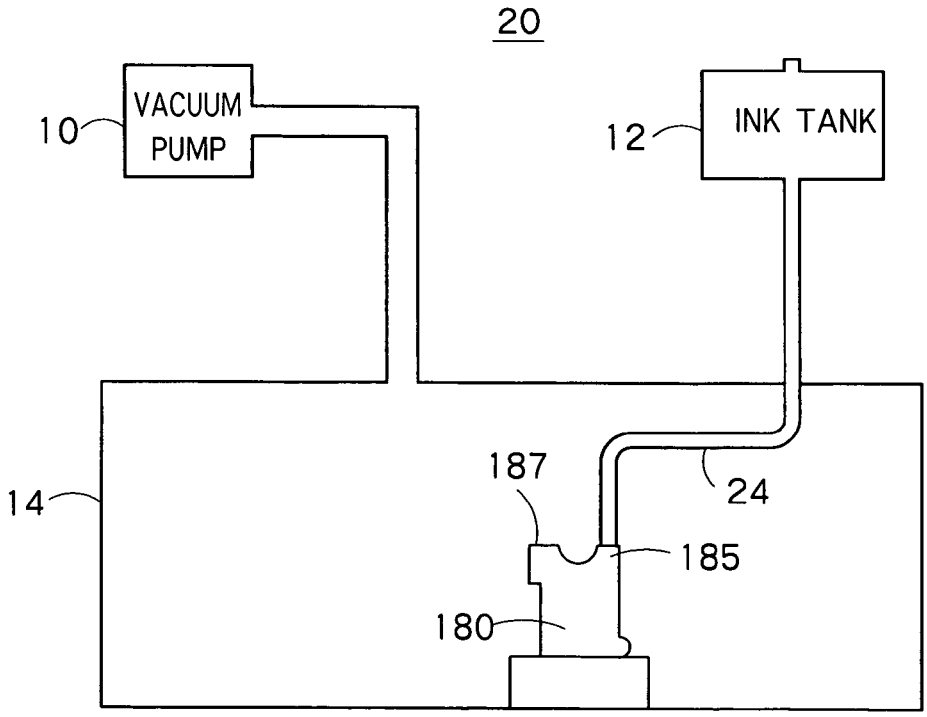
FIG. 5 is a drawing showing the constitution of an ink charging device for charging the ink cartridge with ink by an embodiment of the liquid charging method of the present invention.

FIG. 5 shows the constitution of an ink charging device 20 for charging the ink cartridge 180 with ink. The ink charging device 20 has a vacuum container 14 for internally installing the ink cartridge 180, a vacuum pump 10 for sucking and removing air from the vacuum container 14, thereby decompressing the ink cartridge 180, and an ink tank 12 for feeding ink to the ink cartridge 180 and charging it.

To charge the ink cartridge 180 with ink, the ink cartridge 180 is installed in the vacuum container 14 first. Next, the air inlet 185 of the ink cartridge 180 is closed and air is sucked and removed from the vacuum container 14 by the vacuum pump 10 so as to decompress it. Then, air in the ink cartridge 180 is sucked and removed from the ink feed port 187 into the vacuum container 14, so that the ink cartridge 180 is decompressed. At that time, air in the cavity 162 of the actuator 106 mounted to the ink cartridge 180 are removed. Next, the ink feed port 187 of the ink cartridge 180 is closed, and the ink feed tube 24 connected to the ink tank 12 is connected to the air inlet 185 of the ink cartridge 180, and ink K is fed from the ink tank 12 to the ink cartridge 180. When connecting the ink feed tube 24 to the ink cartridge 180, a hollow needle may be installed at the end of the ink feed tube 24 and pierced into the air inlet 185. Since the ink cartridge 180 is decompressed, no air bubbles remain in the cavity 162. Therefore, when the ink cartridge 180 is charged with ink, the cavity 162 can be easily charged with ink K. When the charging of the ink cartridge 180 with ink is finished, the air inlet 185 of the ink cartridge 180 is closed, and the ink cartridge 180 is removed from the vacuum container 14, and the charging of ink is finished. Inversely to the method aforementioned, it is possible to close the ink feed port 187 first, suck and remove air from the air inlet 185 so as to decompress, and charge the ink cartridge 180 with ink via the ink feed port 187. Furthermore, both suction and removal of air and charging of ink can be executed by either of the air inlet 185 and the ink feed port 187.

At the time of ending of ink charging into the ink cartridge 180, a predetermined amount of ink may be sucked and ejected via the ink feed port 187 of the ink cartridge 180. When a predetermined amount of ink is sucked at the time of ending of ink charging, air bubbles dissolved in ink at the time of ink charging can be sucked and removed together with ink. Moreover, air bubbles which may remain in the ink feed port 187 can be sucked out at a stroke. By removing air bubbles dissolved in ink, deterioration of the print quality due to entry of air bubbles dissolved in ink into the recording head and malfunctions due to adhering of air bubbles to the actuator 106 can be prevented. The time of ending of ink charging may be the point of time just before the actual ending of ink charging, or the point of time simultaneously with the actual ending of ink charging, or the point of time immediately after the actual ending of ink charging.

Furthermore, at the time of decompression of the ink cartridge 180, it is preferable to decompress the ink cartridge 180 while keeping it warm. When the ink cartridge 180 is kept warm at the time of decompression like this, the viscosity of ink to be charged at the time of ink charging is lowered and the ink cartridge 180 is easily charged with ink. Further, at the time of charging the ink cartridge 180 with ink, the ink cartridge 180 may be kept warm or the ink to be charged may be kept warm.

Figure 6:
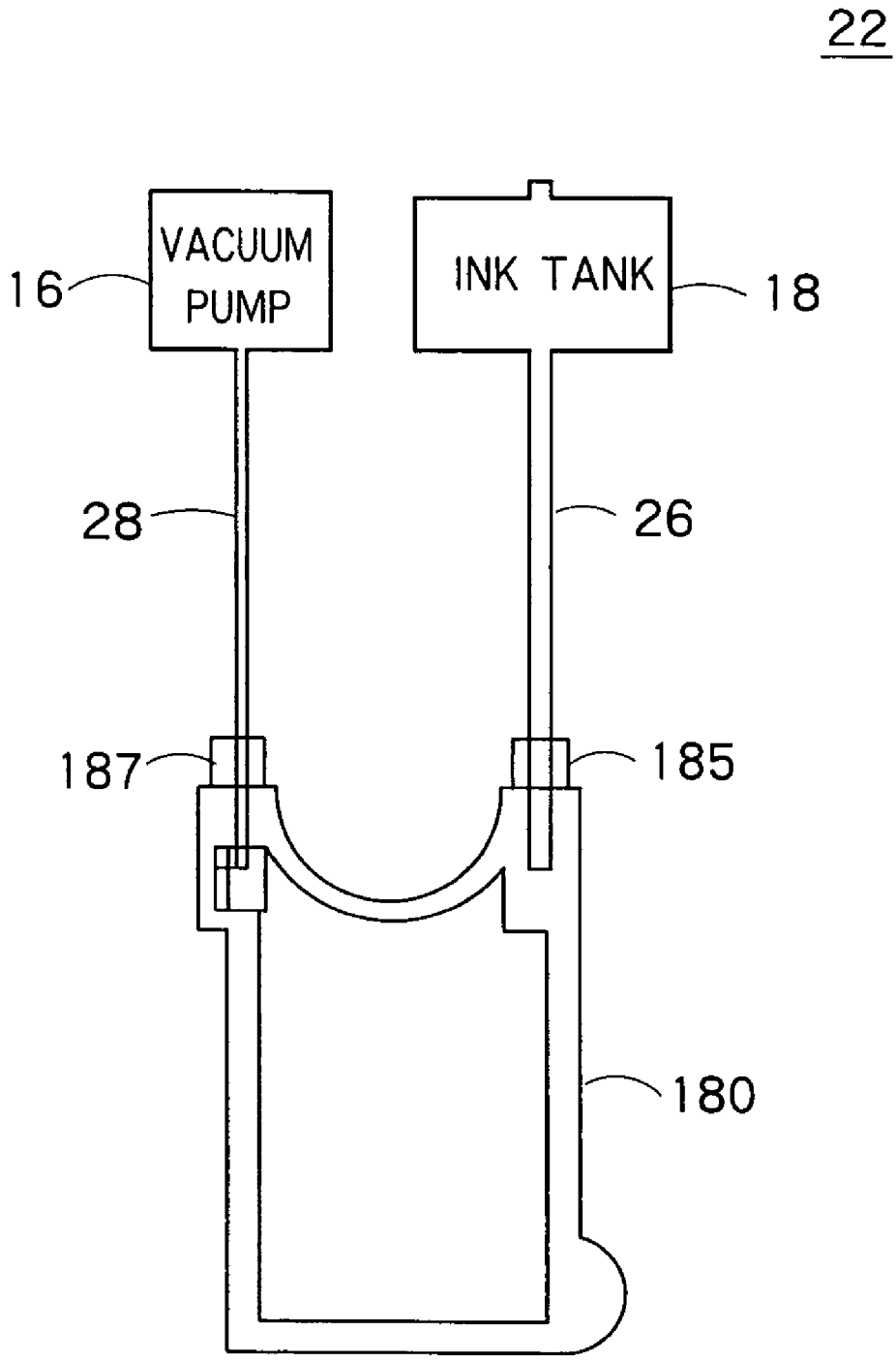
FIG. 6 is a drawing showing the constitution of an ink charging device for charging the ink cartridge with ink by another embodiment of the liquid charging method of the present invention.

FIG. 6 shows another embodiment of the ink charging device. In this embodiment, an ink charging device 22 for decompressing the ink cartridge 180 is used instead of the vacuum container 14. The ink charging device 22 has a vacuum pump 16 for sucking and removing air from the ink cartridge 180, thereby decompressing it and an ink tank 18 for feeding ink and charging the ink cartridge 180.

To charge the ink cartridge 180 with ink, the air inlet 185 is closed first and an air suction tube 28 connected to the vacuum pump 16 is connected to the ink feed port 187 of the ink cartridge 180. A hollow needle is installed at the end of the air suction tube 28 and pierced into the ink feed port 187, thus the air suction tube 28 may be connected to the ink cartridge 180.

Next, the vacuum pump 16 is driven and air is sucked and removed from the ink cartridge 180 so as to decompress it. Then, air existing in the cavity 162 of the actuator 106 mounted to the ink cartridge 180 is also removed.

Next, the ink feed port 187 is closed, and an ink feed tube 26 connected to the ink tank 18 is connected to the air inlet 185 of the ink cartridge 180, and ink is fed to the ink cartridge 180 from the ink tank 18. A hollow needle is installed at the end of the ink feed tube 26 and pierced into the air inlet 185, thus the ink feed tube 26 may be connected to the ink cartridge 180. Since the ink cartridge 180 is decompressed, no air remains in the cavity 162. Therefore, when the ink cartridge 180 is charged with ink, the cavity 162 can be easily charged with ink.

When the charging of the ink cartridge 180 with ink is finished, the air inlet 185 and the ink feed port 187 are closed and the charging of ink is finished. Inversely to the method aforementioned, it is possible to suck and remove air from the air inlet 185 so as to decompress and charge the ink cartridge 180 with ink via the ink feed port 187. Furthermore, both suction and removal of air and charging of ink can be executed by either of the air inlet 185 and the ink feed port 187.

At the time of ending of ink charging into the ink cartridge 180, a predetermined amount of ink may be sucked and ejected from the ink feed port 187 of the ink cartridge 180. When a predetermined amount of ink is sucked at the time of ending of ink charging, air bubbles dissolved in ink at the time of ink charging can be sucked and removed together with ink. Moreover, air bubbles which may remain in the ink feed port 187 can be sucked out at a stroke. By removing air bubbles dissolved in ink, deterioration of the print quality due to entry of air bubbles dissolved in ink into the recording head and malfunctions due to adhering of air bubbles to the actuator 106 can be prevented. The time of ending of ink charging may be the point of time just before the actual ending of ink charging, or the point of time simultaneously with the actual ending of ink charging, or the point of time immediately after the actual ending of ink charging.

Further, when air is sucked and removed from the ink cartridge 180 so as to decompress it, the ink cartridge 180 may be charged with ink at the same time. In this case, it is desirable to connect the ink feed tube 26 connected to the ink tank 18 to the air inlet 185 before hand before decompressing the ink cartridge 180 and feed ink to the ink cartridge from the ink tank 18 simultaneously with decompressing the ink cartridge 180. By this method, the time required to charge the ink cartridge 180 with ink is shortened.

In this case, it is preferable that the flow rate of air sucked from the ink cartridge 180 is larger than the flow rate of ink charged in the ink cartridge 180. Further, at the time of decompressing the ink cartridge 180, it is preferable to decompress the ink cartridge 180 while keeping it warm. When the ink cartridge 180 is kept warm like this at the time of decompression, the viscosity of ink to be charged at the time of ink charging is lowered and the ink cartridge 180 can be easily charged with ink. Further, at the time of charging the ink cartridge 180 with ink, the ink cartridge 180 may be kept warm or the ink to be charged may be kept warm.

Figure 7:
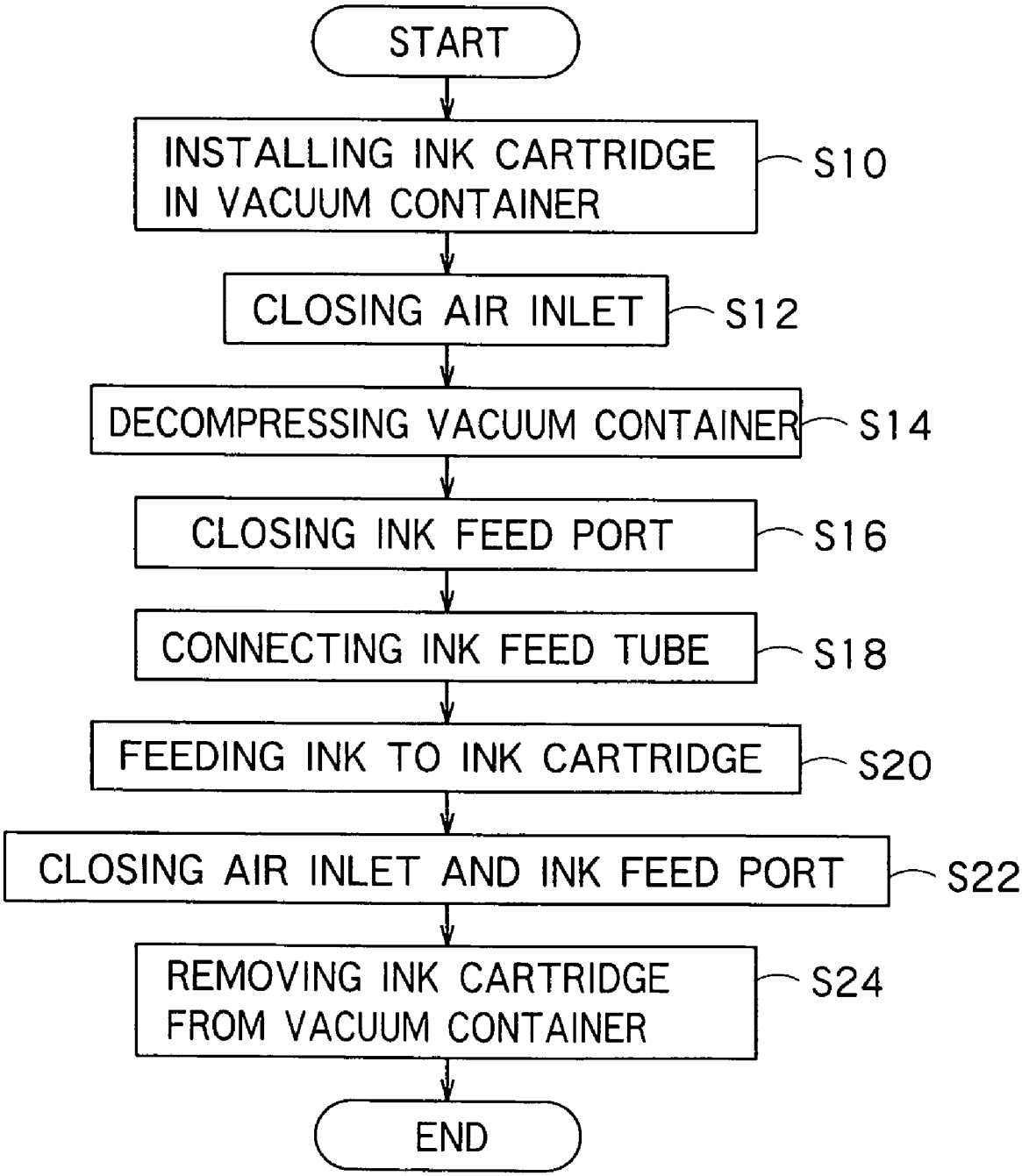
FIG. 7 is a drawing showing the ink charging procedure using the ink charging device shown in FIG. 5.

FIG. 7 shows the procedure of ink charging using the ink charging device 20 shown in FIG. 5. Firstly, the ink cartridge 180 is installed in the vacuum container 14 (S10). Next, the air inlet 185 of the ink cartridge 180 is closed (S12). Next, air is sucked and removed from the vacuum container 14 by the vacuum pump 10 so as to decompress it, thus the ink cartridge 180 is decompressed (S14). Next, the ink feed port 187 of the ink cartridge 180 is closed (S16). Next, the ink feed tube 24 is connected to the air inlet 185 of the ink cartridge 180 (S18). Next, ink is fed to the ink cartridge 180 from the ink tank 12 (S20). Next, when the ink charging into the ink cartridge 180 is finished, the air inlet 185 and the ink feed port 187 of the ink cartridge 180 are closed (S22). Finally, the ink cartridge 180 is removed from the vacuum container 14 (S24) and the ink charging procedure is finished. Inversely to the method aforementioned, it is possible to close the ink feed port 187 first, suck and remove air from the air inlet 185 so as to decompress, and then charge the ink cartridge 180 with ink from the ink feed port 187.

Figure 8:
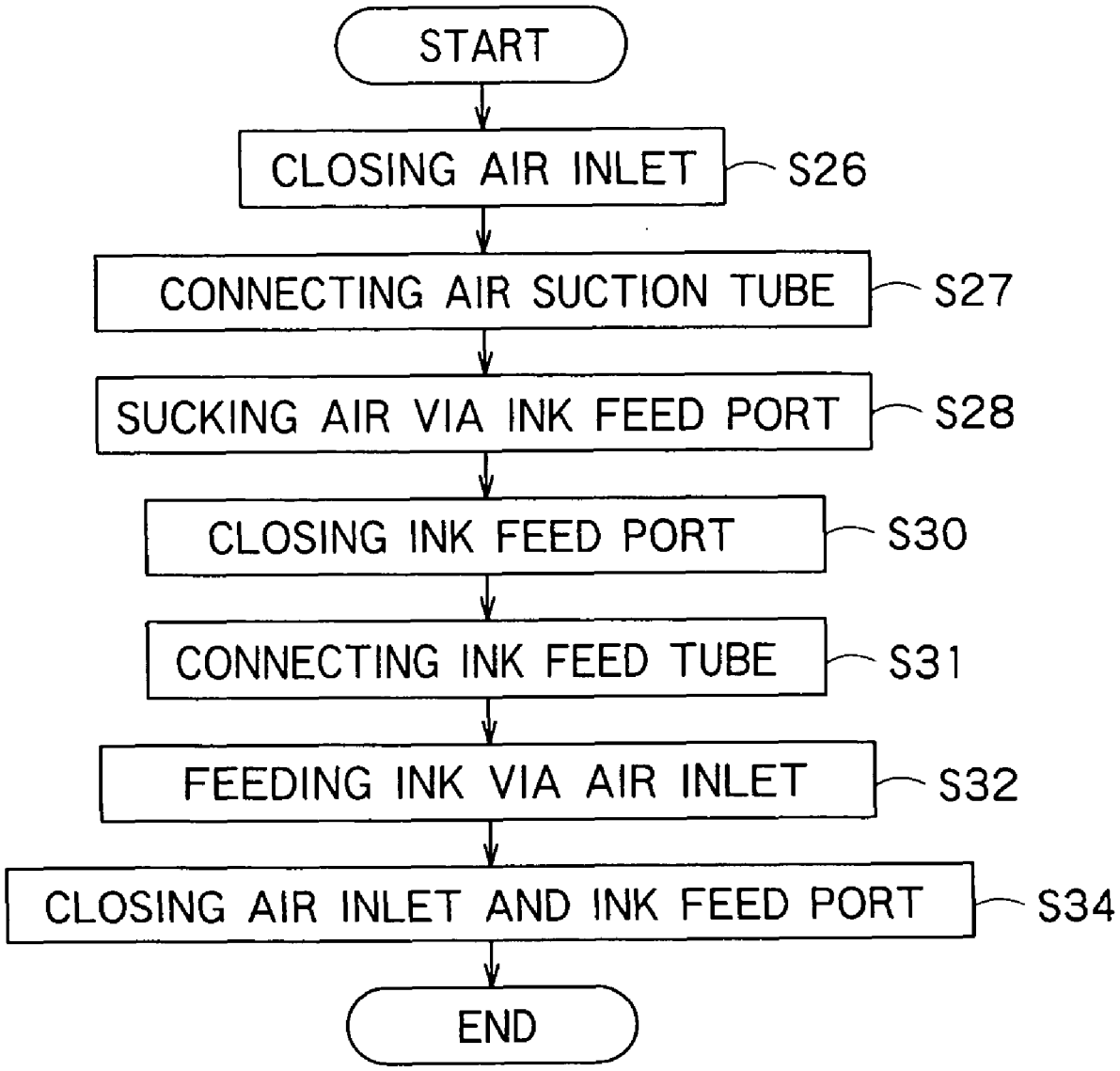
FIG. 8 is a drawing showing the ink charging procedure using the ink charging device shown in FIG. 6.

FIG. 8 shows the procedure of ink charging using the ink charging device 22 shown in FIG. 6. Firstly, the air inlet 185 is closed (S26) and the air suction tube 28 connected to the vacuum pump 16 is connected to the ink feed port 187 of the ink cartridge 180 (S27). Next, the vacuum pump 16 is driven and air is sucked and removed from the ink cartridge 180 so as to decompress it (S28). Next, the ink feed port 187 is closed (S30), and the ink feed tube 26 connected to the ink tank 18 is connected to the air inlet 185 of the ink cartridge 180 (S31), and ink is fed from the ink tank 18 to the ink cartridge 180 (S32). When the ink charging into the ink cartridge 180 is finished, the air inlet 185 and the ink feed port 187 are closed (S34) and the ink charging procedure is finished.

The procedure of feeding ink via the air inlet 185 and decompressing via the ink feed port 187 is explained above. However, it is possible to feed ink via the ink feed port 187 and decompress via the air inlet 185. Further, to decompress the ink cartridge 180, an exclusive decompression opening may be formed in the ink cartridge 180.

The ink charging device and ink charging method aforementioned may be used for a used ink cartridge 180. Recharging the used ink cartridge with ink is more difficult than charging a new ink cartridge with ink. In the used ink cartridge, ink is adhered to the part in the neighborhood of the ink feed port 187 or in the cavity 162 of the actuator 106 where fine slits and holes exist while in use and air may be shut in the slits and holes. When the ink in the ink cartridge is exhausted in this state and the ink cartridge is withdrawn, at the time of recharging the ink cartridge with ink, it is difficult to charge the slits and holes, where ink is adhered and air is shut in by the ordinary charging method, with ink. Here, when the ink charging device and the ink charging method shown in FIGS. 5 to 8 are used, by decompressing the ink cartridge 180, ink shutting air in the slits and holes and air shut in the slits and holes by ink are sucked and removed and the slits and holes can be easily charged with ink.

FIG. 9A, FIG. 9B, FIG. 9C and FIG. 9D show still other embodiments of the ink cartridge 180. An ink cartridge 180G of FIG. 9A has multiple partition walls 212 extending from the upper surface 194*c* of the ink container 194 to the lower portion. Since the predetermined gap is formed between the lower ends of the respective partition walls 212 and the bottom surface of the ink container 194, the bottom portion of the ink container 194 is communicated. The ink cartridge 180G has the multiple containing chambers 213 laid out per block by the multiple partition walls 212. The bottom portions of the multiple containing chambers 213 are communicated with each other. In the respective multiple containing chambers 213, the actuators 106 are mounted on the upper surface 194*c* of the ink container 194. It is preferably that the multiple actuators 106 integrally molded as shown in FIGS. 2A, 2B and 2C are employed as these multiple actuators 106. The actuators 106 are arranged approximately at the center of the upper surface 194*c* of the containing chambers 213 of the ink container 194. The largest volume of the containing chambers 213 is the volume of the containing chamber on the side of the ink feed port 187, and as the containing chambers away from the ink feed port 187 toward the backward of the ink container 194, the volume of the containing chambers 213 are gradually smaller. Therefore, intervals at which the actuators 106 are arranged is wider on the side of the ink feed port 187, and the far away from the ink feed port 187 to the interior of the ink container 194, the narrower the intervals become.

Since the ink is drained from the ink feed port 187 and the air enters from the air inlet 185, the ink is consumed from the containing chamber 213 on the side of the ink feed port 187 to the containing chamber 213 located backward of the ink cartridge 180G. For example, the ink of the containing chamber 213 nearest from the ink feed port 187 is consumed, and during the ink liquid level of the containing chamber 213 nearest from the ink feed port 187 is lowered, the ink is filled within the other containing chambers 213. When the ink of the containing chamber 213 nearest from the ink feed port 187 is completely consumed, the air invades into the containing chamber 213 secondly numbered from the ink feed port 187, the ink within the second containing chamber 213 begins to be consumed, and the ink liquid level of the second containing chamber 213 begins to be lowered. At this point in time, in the containing chambers after the containing chamber 213 thirdly numbered from the ink feed port 187, the ink is filled. In this way, the ink is consumed in turn from the containing chamber 213 nearest from the ink feed port 187 to the containing chamber 213 which is far from the ink feed port 187.

In this way, since the actuators 106 are arranged on the upper surface 194*c* of the ink container 194 at the intervals per each containing chamber 213, the actuators 106 can detect the reduction of the ink volume step by step. Furthermore, the volume of the containing chamber 213 is gradually smaller from the volume of the containing chamber on the side of the ink feed port 187 to the volume of the backward of the containing chamber 213, a time interval from the point in time at which the actuator 106 detects the reduction of the ink volume to the next point in time at which the actuator 106 detects the reduction of the ink volume is gradually small, and the more it is close to the ink end, the more frequently it can detect.

Figure 9A:
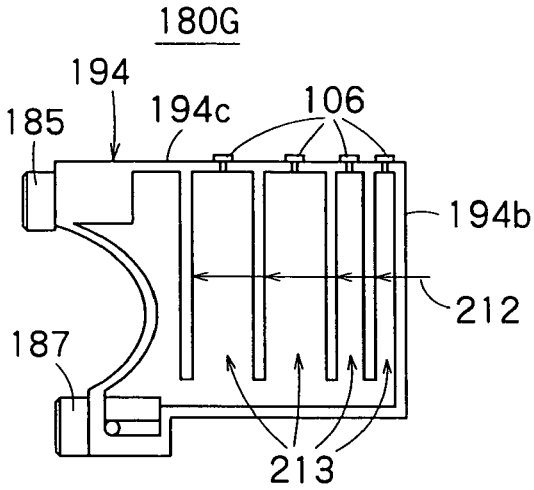
FIGS. 9A, 9B, 9C and 9D are drawings showing ink cartridges which are other embodiments of the liquid container of the present invention.

In an ink cartridge 180G shown in FIG. 9A, it is difficult to charge a containing chamber 213 farthest away from the ink feed port 187 with ink. Particularly, the containing chamber 213 on the innermost side is narrow, so that it is difficult to charge it with ink. Furthermore, it is more difficult to remove air bubbles remaining in the cavity 162 of the actuator 106 mounted to the farthest containing chamber 213 from the ink feed port 187 and charge it with ink.

In this case, when the ink charging device and the ink charging method shown in FIGS. 5 to 8 are used, the containing chamber 213 and the cavity 162 of the actuator 106 mounted to the containing chamber 213 can be easily charged with ink. Since the containing chamber 213 farthest away from the ink feed port 187 is to be charged with ink, it is possible to form an opening in the upper part of the containing chamber 213 farthest away from the ink feed port 187, charge ink from the opening, and then charge ink in the containing chamber 213 neighboring to the ink feed port 187. Further, it is possible to charge the containing chamber 213 neighboring to the ink feed port first and then the containing chamber 213 farther away from the ink feed port with ink.

Figure 9B:
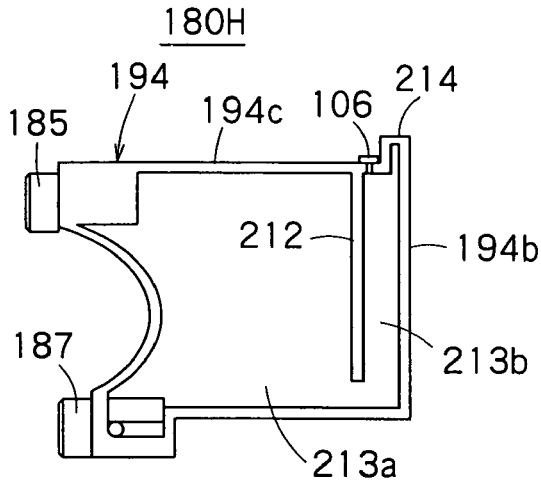

An ink cartridge 180H of FIG. 9B has one partition wall 212 extending from the upper surface 194*c* of the ink container 194 to the lower portion. Since the predetermined interval is spaced between the lower end of the partition wall 212 and the bottom surface of the ink container 194, the bottom portion of the ink container 194 is communicated. The ink cartridge 180H has two containing chambers 213*a* and 213*b* divided by the partition wall 212. The bottom portions of the containing chambers 213*a* and 213*b* are communicated with each other. The volume of the containing chamber 213*a* on the side of the ink feed port 187 is larger than that of the containing chamber 213*b* backward from the ink feed port 187. It is preferable that the volume of the containing chamber 213*b* is smaller than a half of the volume of the containing chamber 213*a*.

The actuator 106 is mounted on the upper surface 194*c* of the containing chamber 213*b*. Furthermore, in the containing chamber 213*b*, a buffer 214 which is a channel for catching bubbles entering at the time of manufacturing the ink cartridge 180H is formed. In FIG. 9B, the buffer 214 is formed as a channel extending from the side wall 194*b* of the ink container 194 to the upper portion. Since the buffer 214 catches the bubbles invaded within the ink containing chamber 213*b*, it can prevent the actuator 106 from malfunctioning to detect an ink end by the bubbles. Moreover, by providing the actuator 106 on the upper surface 194*c* of the containing chamber 213*b*, and by correcting an ink volume from the point in time when the ink near end is detected to the point in time when it is completely ink end state by corresponding to the ink consuming state in the containing chamber 213*a* grasped by dot counter, the ink can be consumed to the last. Furthermore, a consumable ink volume after the ink near end is detected can be changed by adjusting the volume of the containing chamber 213*b* by changing the lengths and intervals of the partition wall 212 and the like.

In an ink cartridge 180H shown in FIG. 9B, it is difficult to charge a containing chamber 213*b* farther away from the ink feed port 187 with ink. Furthermore, it is more difficult to remove air bubbles remaining in the cavity 162 of the actuator 106 mounted to the containing chamber 213*b* and charge it with ink. In this case, when the ink charging device and the ink charging method shown in FIGS. 5 to 8 are used, the containing chamber 213*b* and the cavity 162 of the actuator 106 mounted to the containing chamber 213*b* can be easily charged with ink. Since the containing chamber 213*b* farther away from the ink feed port 187 is to be charged with ink, it is possible to form an opening in the upper part of a buffer 214, charge ink from the opening, and then charge ink in the containing chamber 213*a* neighboring to the ink feed port 187. Further, it is possible to charge the containing chamber 213*a* neighboring to the ink feed port first and then the containing chamber 213*b* farther away from the ink feed port with ink.

Figure 9C:
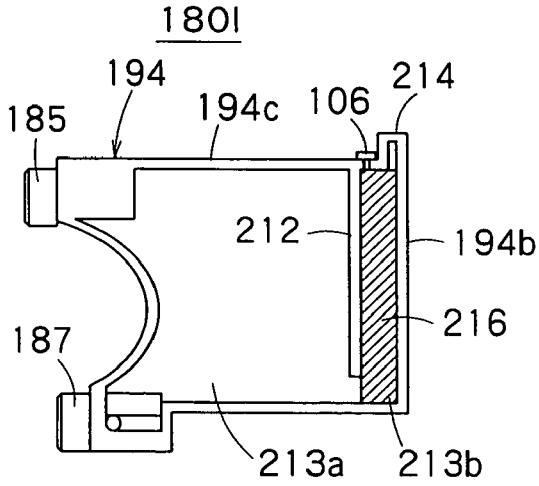

In FIG. 9C, the containing chamber 213*b* of an ink cartridge 180I of FIG. 9B is filled with a porous member 216. The porous member 216 is set so as to embed the whole space from the upper surface within the containing chamber 213*b* to the lower surface. The porous member 216 contacts with the actuator 106. When the ink container fell down or during the reciprocation movement on the carriage, the air invades the containing chamber 213*b*, thereby resulting in a risk for causing the malfunction of the actuator 106. However, if the porous member 216 is equipped with it, the porous member 216 can prevent the actuator 106 from being invaded by the air by catching the air. Moreover, since the porous member 216 holds the ink, it can prevent that the ink runs over the actuator 106 and the actuator 106 falsely detects the presence of the ink by swinging the ink container although there is no ink under normal state. It is preferable that the porous member 216 is set in the containing chamber 213 of the smallest volume.

Moreover, the ink can be consumed to the last by providing the actuator 106 on the upper surface 194*c* of the containing chamber 213*b* and by correcting an ink volume from the point in time when the ink near end is detected to the point in time when it is in a complete ink end state. Furthermore, a consumable ink volume after the ink near end is detected can be changed by adjusting the volume of the containing chamber 213*b* by changing the lengths and intervals of the partition walls 212 and the like.

In an ink cartridge 180I shown in FIG. 9C, it is difficult to charge a containing chamber 213*b* with a porous member 216 installed farther away from the ink feed port 187 with ink. Furthermore, it is more difficult to charge the cavity 162 of the actuator 106 mounted to the containing chamber 213*b* with ink without leaving air bubbles. In this case, when the ink charging device and the ink charging method shown in FIGS. 5 to 8 are used, the containing chamber 213*b*, the cavity 162 of the actuator 106 mounted to the containing chamber 213*b*, and the porous member 216 can be easily charged with ink. Since the containing chamber 213*b* farther away from the ink feed port 187 is to be charged with ink, it is possible to form an opening in the upper part of a buffer 214, charge ink from the opening, and then charge ink in the containing chamber 213*a* neighboring to the ink feed port 187. Further, it is possible to charge the containing chamber 213*a* neighboring to the ink feed port first and then the containing chamber 213*b* farther away from the ink feed port with ink.

Figure 9D:
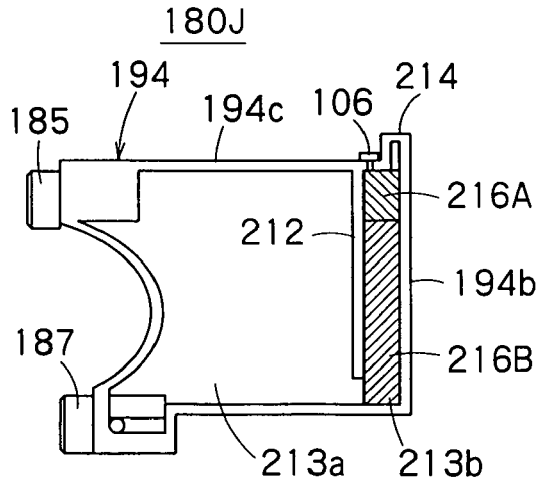

FIG. 9D shows an ink cartridge 180J composed of two kinds of porous member 216A and 216B having different pore sizes instead of the porous member 216 of the ink cartridge 180I of FIG. 9C. The porous member 216A is arranged in the upper portion of the porous member 216B. The pore size of the porous member 216A of the upper side is larger than the pore size of the porous member 216B of the lower side. Or, the porous member 216A is formed by the member whose affinity for a liquid is higher than that of the porous member 216B.

Since the capillary attraction of the porous member 216B whose pore size is small is larger than that of the porous member 216A whose pore size is large, the ink within the containing chamber 213*b* congregates to the porous member 216B of the lower side, and held. Therefore, once the air arrives at the actuator 106 and the absence of the ink is detected, there is no chance that the ink arrives at the actuator again and the presence of the ink is detected. Furthermore, since the ink is absorbed by the porous member 216B of the far side from the actuator 106, the ink nearby the actuator 106 is drained well, and a changing value of the acoustic impedance when the presence or absence of the ink is detected. Moreover, the ink can be consumed to the last by providing the actuator 106 on the upper surface of the containing chamber 213*b* and by correcting an ink volume from the point in time when the ink near end is detected to the point in time when the ink is in a complete ink end state. Furthermore, a consumable ink volume after the ink near end is detected can be changed by adjusting the volume of the containing chamber 213*b* by changing the lengths and intervals of the partition walls 212 and the like.

In an ink cartridge 180J shown in FIG. 9D, it is difficult to charge a containing chamber 213*b* with porous members 216A and 216B installed farther away from the ink feed port 187 with ink. Furthermore, it is more difficult to charge the cavity 162 of the actuator 106 mounted to the containing chamber 213*b* with ink without leaving air bubbles there. In this case, when the ink charging device and the ink charging method shown in FIGS. 5 to 8 are used, the containing chamber 213*b* with the porous members 216A and 216B installed and the cavity 162 of the actuator 106 mounted to the containing chamber 213*b* can be easily charged with ink. Since the containing chamber 213*b* farther away from the ink feed port 187 is to be charged with ink, it is possible to form an opening in the upper part of a buffer 214, charge ink from the opening, and then charge ink in the containing chamber 213*a* neighboring to the ink feed port 187. Further, it is possible to charge the containing chamber 213*a* neighboring to the ink feed port first and then the containing chamber 213*b* farther away from the ink feed port with ink.

Figure 10A:
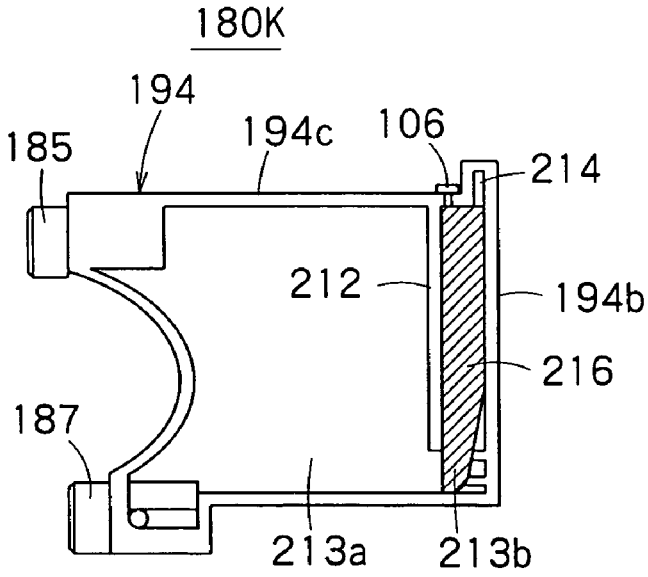
FIGS. 10A, 10B and 10C are sectional views showing varied examples of the ink cartridge shown in FIG. 9C.
Figure 10B:
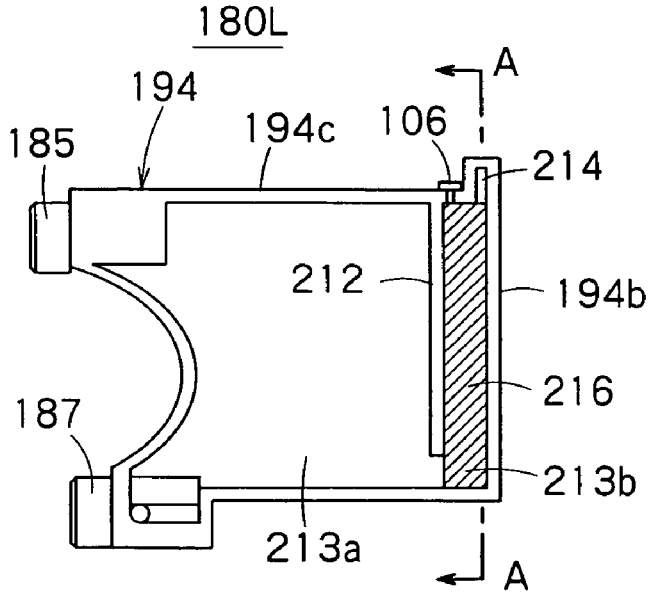
Figure 10C:
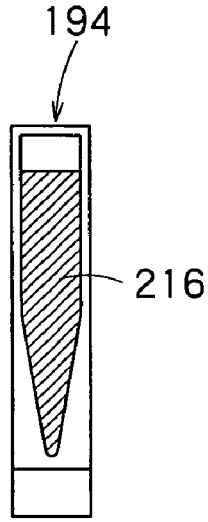

FIG. 10A, FIG. 10B and FIG. 10C are sectional views showing ink cartridges 180K, 180L which are other embodiments of the ink cartridge 180I shown in FIG. 9C. The porous members 216 of the ink cartridges 180K, 180L shown in FIG. 10A, FIG. 10B and FIG. 10C are designed so that sectional areas in the horizontal direction of the lower portions of the porous members 216 are compressed so as to be gradually smaller toward the bottom surface of the ink container 194 and their pore sizes are smaller toward the bottom surface. In the ink cartridge 180K of FIG. 10A, a rib is provided on the side wall to compress the porous member so that the pore size of the porous member 216 of the lower side is smaller.

Since the pore size of the lower portion of the porous member 216 is compressed and be small, the ink is congregated to the lower portion of the porous member 216 and held. Since the ink is absorbed by the porous member 216B of the far side from the actuator 106, the ink nearby the actuator 106 is drained well, and a changing value of the acoustic impedance when the presence or absence of the ink is detected. Therefore, it can be prevented that the ink runs over the actuator 106 mounted on the upper surface of the ink cartridge 180K by the ink swinging and the actuator 106 falsely detects the presence of the ink although there is no ink under normal state.

On the other hand, in an ink cartridge 180L of FIG. 10B and FIG. 10C, sectional area in the horizontal direction of the lower portion of the porous member 216 is compressed so as to be gradually smaller toward the bottom surface of the ink container 194 and its pore size is gradually smaller toward the bottom surface.

Since the pore size of the porous member of the lower portion is compressed and be small, the ink is congregated to the lower portion of the porous member 216 and held. Since the ink is absorbed by the porous member 216B of the far side from the actuator 106, the ink nearby the actuator 106 is drained well, and a changing value of the acoustic impedance when the presence or absence of the ink is detected. Therefore, it can be prevented that the ink runs over the actuator 106 mounted on the upper surface of the ink cartridge 180K by the ink swinging and the actuator 106 falsely detects the presence of the ink although there is no ink under normal state.

In ink cartridges 180K and 180L shown in FIGS. 10A and 10B, it is difficult to charge a containing chamber 213*b* with the porous member 216 installed farther away from the ink feed port 187 with ink. Furthermore, it is more difficult to charge the cavity 162 of the actuator 106 mounted to the containing chamber 213*b* with ink without leaving air bubbles there. In this case, when the ink charging device and the ink charging method shown in FIGS. 5 to 8 are used, the containing chamber 213*b*, the cavity 162 of the actuator 106 mounted to the containing chamber 213*b*, and the porous member 216 can be easily charged with ink. Since the containing chamber 213*b* farther away from the ink feed port 187 is to be charged with ink, it is possible to form an opening in the upper part of a buffer 214, charge ink from the opening, and then charge ink in the containing chamber 213*a* neighboring to the ink feed port 187. Further, it is possible to charge the containing chamber 213*a* neighboring to the ink feed port first and then the containing chamber 213*b* farther away from the ink feed port with ink.

FIG. 11A, FIG. 11B, FIG. 11C and FIG. 11D show still other embodiments of the ink cartridge using the actuator 106. An ink cartridge 220A of FIG. 11A has a first partition wall 222 extending from the upper surface to the lower portion. Since the predetermined gap is spaced between the lower end of the first partition wall 222 and the bottom surface of the ink cartridge 220A, the ink can flow into the ink feed port 230 through the bottom surface of the ink cartridge 220A. On the side of the ink feed port 230 away from the first partition wall 222, a second partition wall 224 is formed as being stood upward from the bottom surface of the ink cartridge 220A. Since the predetermined gap is spaced between the upper end of the second partition wall 224 and the upper surface of the ink cartridge 220A, the ink can flow into the ink feed port 230 through the upper surface of the ink cartridge 220A.

A first containing chamber 225*a* is formed on the back side of the first partition wall 222, when it is seen from the ink feed port 230, by the first partition wall 222. On the other hand, a second containing chamber 225*b* is formed on the front side of the second partition wall 224, when it is seen from the ink feed port 230, by the second partition wall 224. The volume of the first containing chamber 225*a* is larger than the volume of the second containing chamber 225*b*. The capillary pass 227 is formed by spacing the first partition wall 222 and the second partition wall 224 with each other so that the capillary phenomenon occurs between them. Therefore, the ink of the first containing chamber 225*a* is congregated to the capillary pass 227 by capillary attraction of the capillary pass 227. Therefore, the entrapment of gas and a bubble in the second containing chamber 225*b* can be prevented. Moreover, the ink liquid level within the second containing chamber 225*b* can be gradually and stably lowered. Since the first containing chamber 225*a* is formed on the back side of the second containing chamber 225*b* when it is seen from the ink feed port 230, after the ink of the first containing chamber 225*a* is consumed, the ink of the second containing chamber 225*b* is consumed.

The actuator 106 is mounted on the side wall of the ink feed port 230 side of the ink cartridge 220A, that is to say, on the side wall of the ink feed port 230 side of the second containing chamber 225*b*. The actuator 106 detects an ink consuming state within the second containing chamber 225*b*. An ink remaining volume at the point in time nearer to the ink end can be stably detected by mounting the actuator 106 on the side wall of the second containing chamber 225*b*. Furthermore, an ink remaining volume at which point in time is made as the ink end can be freely set by changing the height at which the actuator 106 is mounted on the side wall of the second containing chamber 225*b*. Since the actuator 106 is not influenced by the ink laterally swinging of the ink cartridge 220A by supplying the ink from the first containing chamber 225*a* to the second containing chamber 225*b* through the capillary pass 227, the actuator 106 can securely measure the ink remaining volume. Furthermore, since the capillary pass 227 holds the ink, it is prevented that the ink is refluxed from the second containing chamber 225*b* to the first containing chamber 225*a*.

A check valve 228 is provided on the upper surface of the ink cartridge 220A. When the ink cartridge 220A is laterally swung, it can be prevented that the ink leaks to the external of the ink cartridge 220A by the check valve 228. Furthermore, the evaporation of the ink from the ink cartridge 220A can be prevented by setting the check valve 228 on the upper surface of the ink cartridge 220A. When the ink within the ink cartridge 220A is consumed and negative pressure within the ink cartridge 220A exceeds over the pressure of the check valve 228, the check valve 228 is opened, absorbs the air into the ink cartridge 220A, and subsequently it is closed and maintains the pressure within the ink cartridge 220A at a certain level.

Figure 11A:
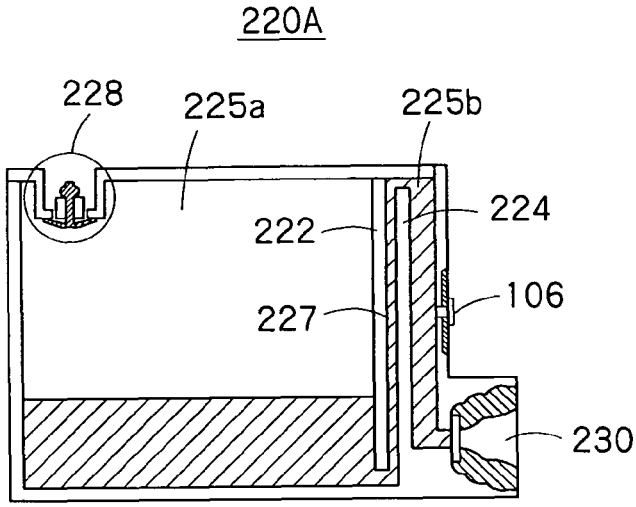
FIGS. 11A, 11B, 11C and 11D are drawings showing ink cartridges which are still other embodiments of the liquid container of the present invention.
Figure 11B:
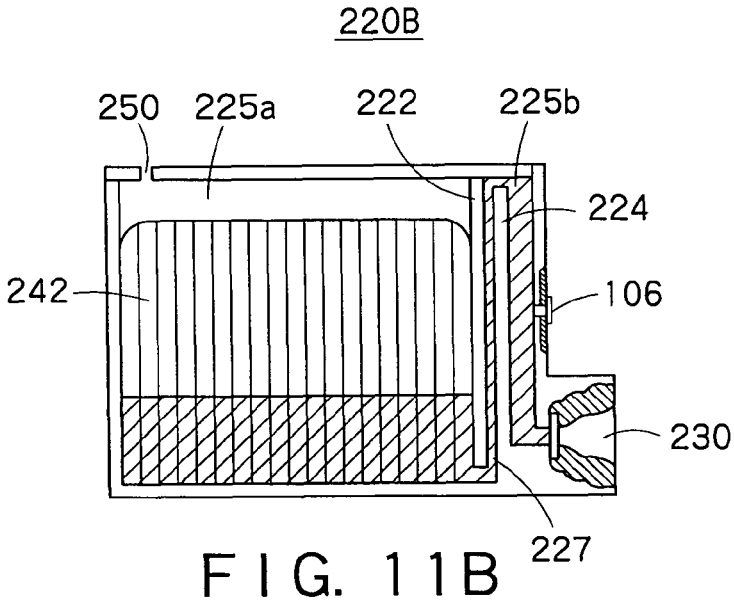
Figure 11C:
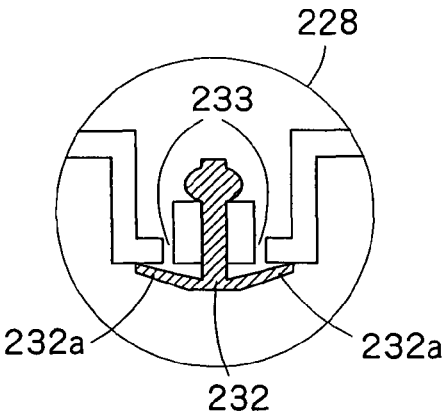
Figure 11D:
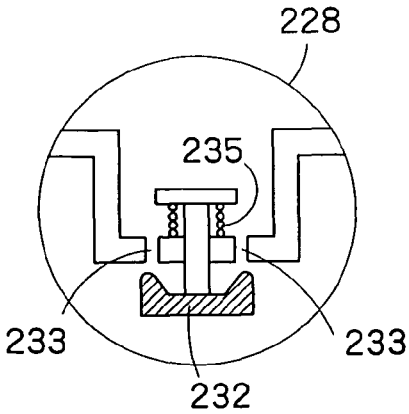

FIG. 11C and FIG. 11D show sections of the check valve 228 in detail. The check valve 228 of FIG. 11C has a valve 232 having a vane 232*a* formed with a rubber. An air hole 233 communicated with the external of the ink cartridge 220 is provided on the ink cartridge 220 as opposing to the vane 232*a*. The air hole 233 is opened and closed by the vane 232*a*. In the check valve 228, when the ink within the ink cartridge 220 is reduced and the negative pressure within the ink cartridge 220 exceeds over the operation pressure of the check valve 228, the vane 232*a* opens inside of the ink cartridge 220, and takes the air of the external into the ink cartridge 220. The check valve 228 of FIG. 11D has the valve 232 formed with a rubber and a spring 235. In the check valve 228, when the negative pressure within the ink cartridge 220 exceeds over the operation pressure of the check valve 228, the valve 232 pushes and pressurizes the spring 235 to be opened, absorbs the air of the external into the ink cartridge 220, and subsequently closed and maintains the negative pressure within the cartridge 220 at a certain level.

In an ink cartridge 220B of FIG. 11B, instead of providing the check valve 228 in the ink cartridge 220A of FIG. 11A, the porous member 242 is arranged. The porous member 242 prevents that the ink leaks to the external of the ink cartridge 220B when the ink cartridge 220B is laterally swung as well as the porous member 242 holds the ink within the ink cartridge 220B.

In an ink cartridge 220A, when ink is fed from a check valve 228, a second containing chamber 225*b* with an actuator 106 mounted may not be charged with ink fully due to a capillary path 227. Further, even if ink is charged from an ink feed port 230, it is difficult to charge a first containing chamber 225*a* with ink fully due to the capillary force of the capillary path 227. Further, it is more difficult to charge the cavity 162 of the actuator 106 mounted to the containing chamber 225*b* with ink without leaving air bubbles there. In this case, when the ink charging device and the ink charging method shown in FIGS. 5 to 8 are used, the containing chambers 225*a* and 225*b* and the cavity 162 of the actuator 106 mounted to the containing chamber 225*b* can be easily charged with ink. For example, when the ink charging device shown in FIG. 5 is used, firstly, the ink cartridge 220A is installed in the vacuum container 14. Next, the check valve 228 is closed and air is sucked from the ink feed port 230 by the vacuum pump 10 so as to decompress the ink cartridge 220A. Next, to charge the ink cartridge 220A with ink, ink may be charged from the ink feed port 230 or ink may be charged from the check valve 228 after closing the ink feed port 230.

In an ink cartridge 220B, when ink is fed from an opening 250 formed in the upper part of the ink feed chamber 225*a*, the second containing chamber 225*b* with the actuator 106 mounted may not be charged with ink fully due to a porous member 242 and the capillary path 227. Further, even if ink is charged from the ink feed port 230, it is difficult to charge the first containing chamber 225*a* with ink fully due to the porous member 242 and the capillary force of the capillary path 227. Further, it is more difficult to charge the cavity 162 of the actuator 106 mounted to the containing chamber 225*b* with ink without leaving air bubbles. In this case, when the ink charging device and the ink charging method shown in FIGS. 5 to 8 are used, the containing chambers 225*a* and 225*b* and the cavity 162 of the actuator 106 mounted to the containing chamber 225*b* can be easily charged with ink. For example, when the ink charging device shown in FIG. 5 is used, firstly, the ink cartridge 220B is installed in the vacuum container 14. Next, the ink feed port 230 is closed and air is sucked from the opening 250 formed in the upper part of the containing chamber 225*a* by the vacuum pump 10 so as to decompress the ink cartridge 220B. Next, to charge the ink cartridge 220B with ink, ink may be charged from the ink feed port 230 or ink may be charged from the opening 250 after closing the ink feed port 230.

Figure 12:
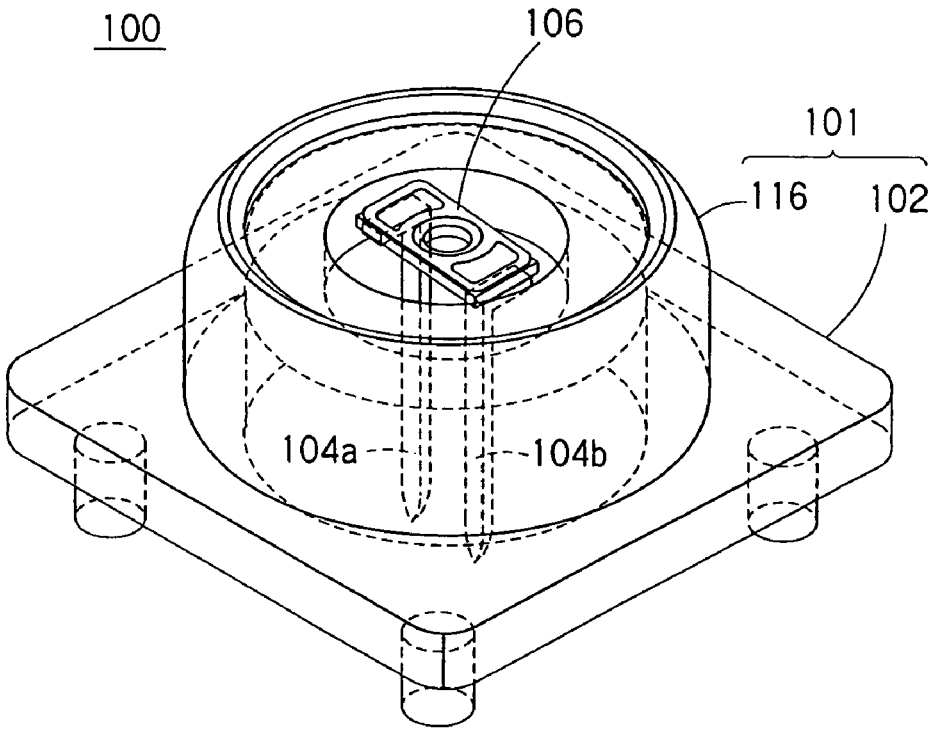
FIG. 12 is a perspective view showing the module body for attaching the actuator shown in FIGS. 2A, 2B and 2C to the container body together with the actuator.

FIG. 12 is a perspective view showing a configuration integrally forming the actuator 106 as a module body 100. The module body 100 is equipped on the predetermined location of the container body 1. The module body 100 is configured so that it detects a consuming state of the liquid within the container body 1 by detecting at least a change of acoustic impedance in the ink liquid.

The module body 100 of the present embodiment has a liquid container mounting portion 101 for mounting the actuator 106 on the container body 1. The liquid container mounting portion 101 is configured such that a circular cylinder portion 116 containing the actuator 106 for oscillating by a drive signal is mounted on the base 102 whose plane is approximately rectangular. Since it is configured so that the actuator 106 of the module body 100 cannot be contacted from the external when the module body 100 is equipped on the ink cartridge, the actuator 106 can be protected from contacting it from the external. It should be noted that an edge of tip side of the circular cylinder portion 116 is formed in a round shape, and it is easily interfitted when it is equipped in the hole formed on the ink cartridge.

Figure 13:
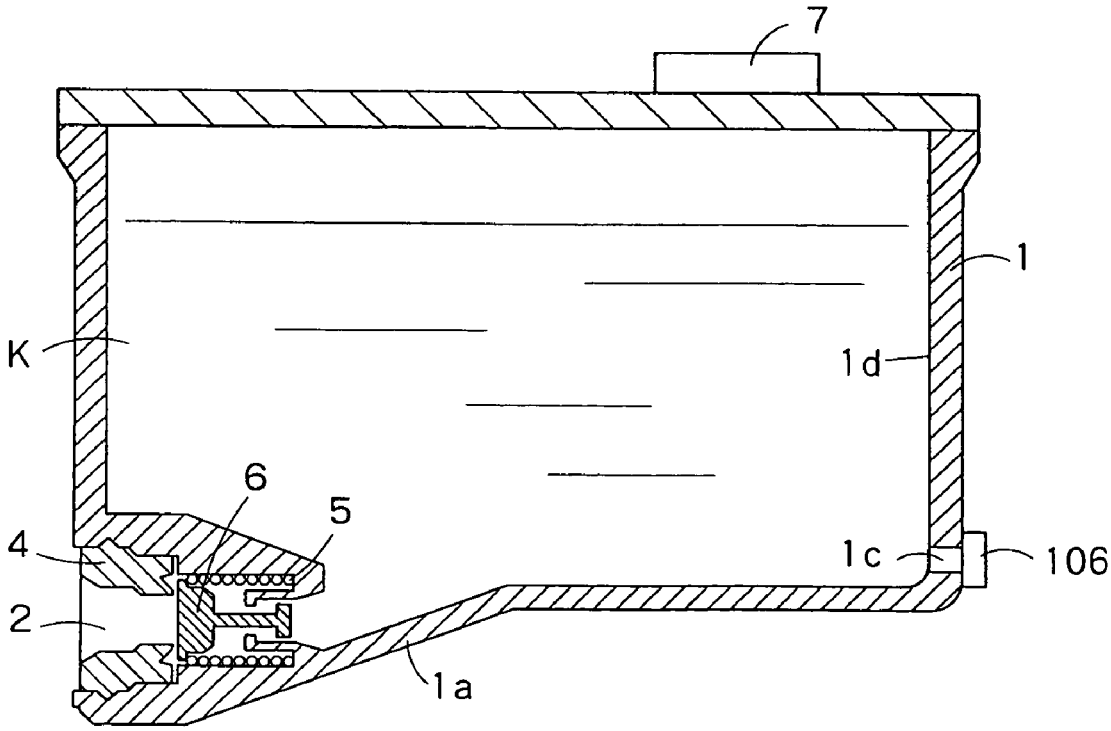
FIG. 13 is a sectional view of an ink cartridge for monochromatic ink, for example, black ink which is an embodiment of the liquid container of the present invention.

FIG. 13 is a cross sectional view of an embodiment of an ink cartridge for monochromatic ink, for example, black ink, to which the present invention is applied. In the ink cartridge shown in FIG. 13, the consumption condition of ink is detected by a method for vibrating the vibration part of a piezo-electric device (an actuator) having a piezo-electric element, thereafter, measuring counter electromotive force generated by the residual vibration remaining in the vibration part, thereby detecting the resonance frequency or the amplitude of counter electromotive force waveform and detecting changes in the acoustic impedance. As a means for detecting changes in the acoustic impedance, the actuator 106 is used.

In the container body 1 for containing ink, the ink feed port 2 joined with the ink feed needle of the recording apparatus is provided. Outside the bottom 1*a* of the container body 1, the actuator 106 is attached so as to come in contact with the internal ink via the through hole 1*c*. In order that the medium in contact with the actuator 106 may change from ink to gas in the stage that ink K is almost consumed, that is, at the point of time of near end of ink, the actuator 106 is installed in a position slightly above the ink feed port 2. A means for generating vibration may be installed independently and the actuator 106 may be used just as a detection means.

Figure 14:
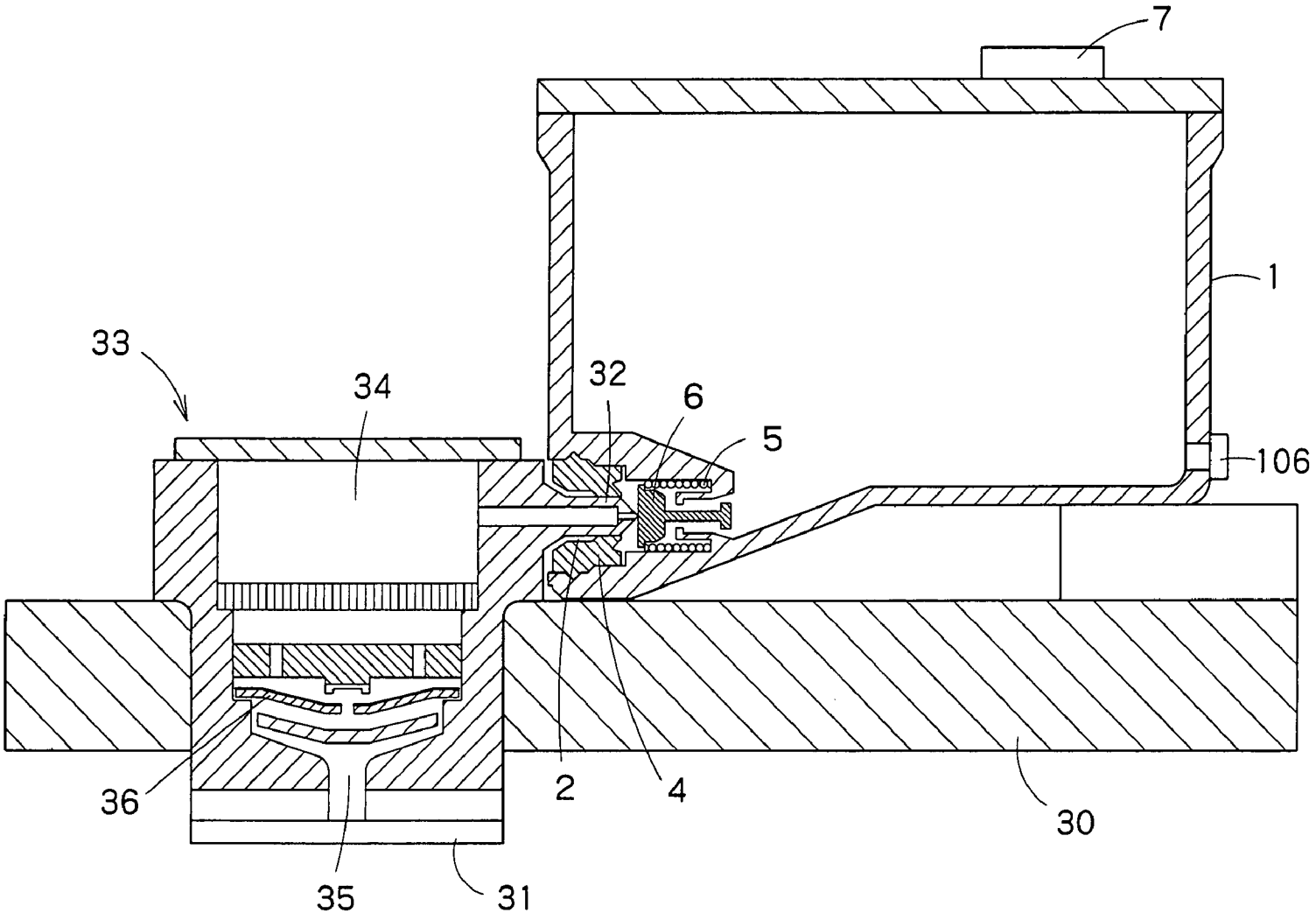
FIG. 14 is a sectional view showing the essential section of an ink jet recording apparatus suited to the ink cartridge shown in FIG. 13.

FIG. 14 is a sectional view showing the essential section of an ink jet recording apparatus suited to the ink cartridge shown in FIG. 13. At the ink feed port 2, a packing 4 and a valve body 6 are installed. As shown in FIG. 14, the packing 4 is connected liquid-tightly to an ink feed needle 32 connecting to a recording head 31. The valve body 6 is elastically connected to the packing 4 by a spring 5. When the ink needle 32 is inserted, the valve body 6 is pressed by the ink feed needle 32 and opens the ink flow path and ink in the container body 1 is fed to the recording head 31 via the ink feed port 2 and the ink feed needle 32. On the upper wall of the container body 1, a semiconductor memory means 7 storing information on ink in the ink cartridge is mounted.

A carriage 30 moving back and forth in the width direction of a recording paper has a sub-tank unit 33 and the recording head 31 is installed on the bottom of the sub-tank unit 33. The ink feed needle 32 is installed on the ink cartridge loading side of the sub-tank unit 33.

The aforementioned ink cartridge of this embodiment has a lyophobic part which is lyophobic to a liquid in the container body. This respect will be explained hereunder.

Figure 15A:
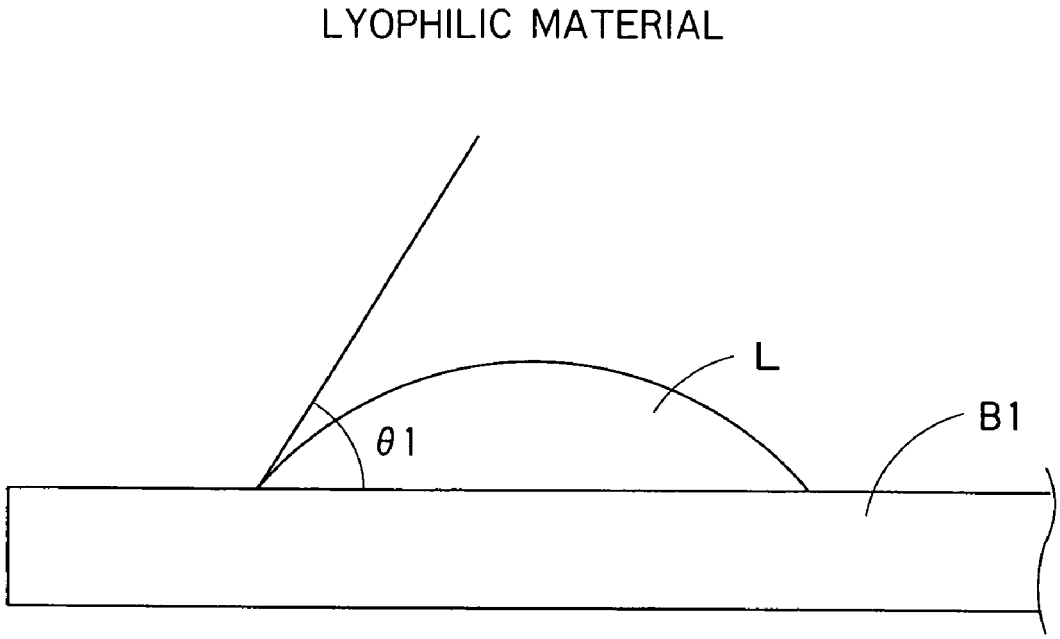
FIGS. 15A and 15B are drawings showing a lyophilic material to a liquid and a lyophobic material to the same, respectively.
Figure 15B:
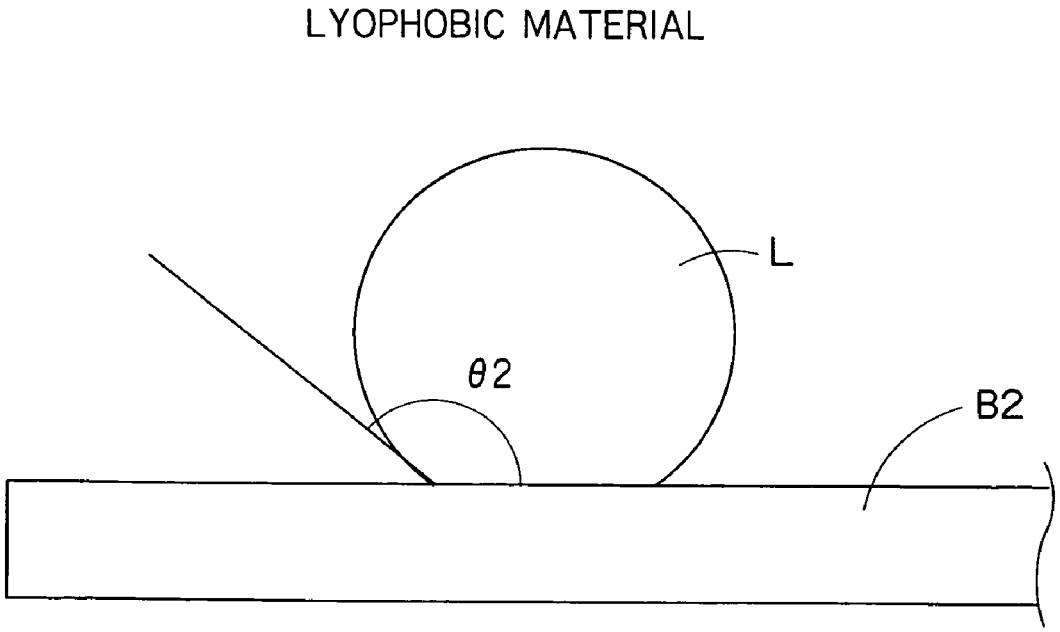

FIGS. 15A and 15B are drawings showing conventional materials and materials lyophobic to an optional liquid, respectively. The lyophobic nature means the lyophobic nature to an optional liquid and includes hydrophobic nature, oilphobic nature, water repellency, oil repellency, water-resistant nature, oil-resistant nature, ultra-hydrophobic nature, ultra-oilphobic nature, ultra-water repellency, ultra-oil repellency, ultra-water-resistant nature, and ultra-oil-resistant nature. A liquid L is in contact with a material B1 or B2 at a contact angle of θ1 or θ2. The contact angle θ1 in FIG. 15A is smaller than the contact angle θ2 in FIG. 15B. The contact angle θ1 is within the range from about 30 degrees to about 60 degrees. The reason is that the material B1 is not lyophobic because it is not subjected to the lyophobic process.

On the other hand, in FIG. 15B, the contact angle θ2 is larger than the contact angle θ1 and the material B2 shows lyophobic nature to the liquid L. Therefore, the material B2 is a lyophobic material to the liquid L. In this embodiment, the contact angle of the liquid to the lyophobic part is about 60 degrees or more and it is preferable that the contact angle is closer to 180 degrees.

With respect to the lyophobic part, the material itself may be lyophobic. Even if the material itself is not lyophobic, the part may be made lyophobic by covering it with a lyophobic material. A highly lyophobic material may be said to be a material having high surface tension of liquid in the relationship with liquid.

Figure 16A:
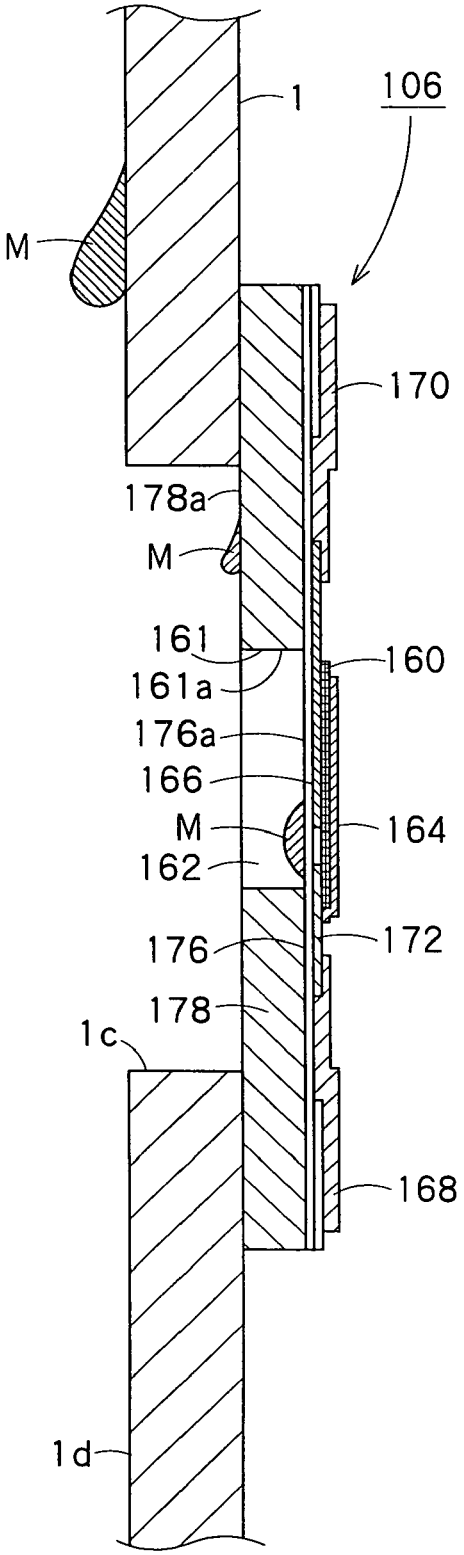
FIGS. 16A and 16B are sectional views of the part of the actuator shown in FIGS. 2A, 2B and 2C which is attached to the container body and enlarged.
Figure 16B:
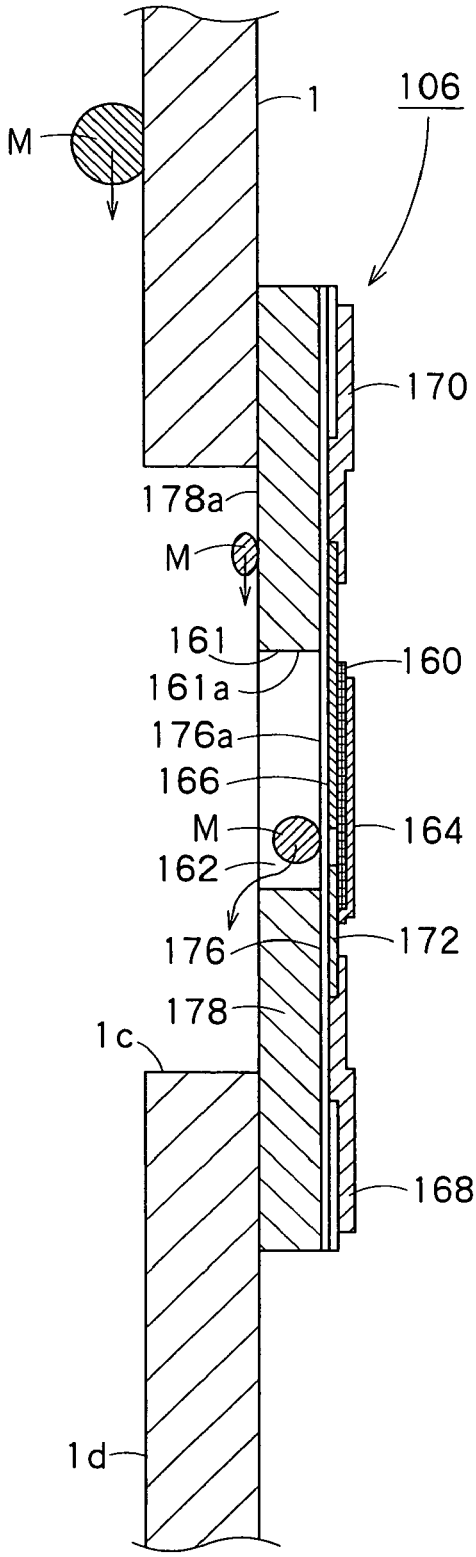

FIGS. 16A and 16B are sectional views of the part of the actuator 106 attached to the side wall of the container body 1 which is enlarged. FIG. 16A is a sectional view of a comparison example having no lyophobic part. FIG. 16B is a sectional view of this embodiment having a lyophobic part.

Since there is no lyophobic part in the comparison example shown in FIG. 16A, if ink is adhered to a vibration area 176*a* by mistake when there is no ink around the actuator 106, an ink drop M stays there. Further, even when ink is adhered around the vibration area 176*a*, the ink drop M may fall and adhere to the vibration area 176*a* by mistake. Therefore, the actuator 106 may detect by mistake that there is ink though there is no ink.

On the other hand, in this embodiment shown in FIG. 16B, the lyophobic part means a part which is inkphobic to ink in the container body 1. The actuator 106 has a lyophobic part which is ink phobic to ink in the container body 1. The vibration area 176*a* of a diaphragm 176 which is at least in contact with ink is included in the lyophobic part. Since the vibration area 176*a* is included in the lyophobic part, even if ink is adhered to the vibration area 176*a* by mistake when there is no ink around the actuator 106, the contact angle with ink is large, thus ink cannot stay in the vibration area 176*a* and falls by the own weight of ink. Therefore, the actuator 106 will not detect by mistake that there is ink though there is no ink.

The circumference of the vibration area 176*a* may be included in the lyophobic part. For example, an inner side 161*a* of the cavity 162 may be included in the lyophobic part. Furthermore, a substrate back 178*a* of a substrate 178 directed inward the container body 1 may be included in the lyophobic part as inkphobic. Further, not only the actuator 106 but also the through hole 1*c* of the container body 1 and the inner wall surface 1*d* of the container body 1 are made inkphobic, thus the actuator 106 and the container body 1 may be included in the lyophobic part. When the circumference of the vibration area 176*a* is made lyophobic like this, ink adhered by mistake will not stay in the cavity 162 and the through hole 1*c*. Thereby, the actuator 106 will not detect by mistake that there is ink though there is no ink.

Furthermore, in addition to the actuator 106, the container body 1, and the ink feed port 2, all the parts in contact with ink in the ink cartridge may be made inkphobic. In such a case, all the parts in contact with ink in the ink cartridge are a lyophobic part.

When the whole part in the ink cartridge is set as a lyophobic part, ink will not stay in the container body 1 and the actuator 106. Therefore, all the ink in the ink cartridge can be used effectively.

When an ink cartridge having a lyophobic part like this is used, at the time of recharging of ink, no ink remains in the ink cartridge, so that new ink can be recharged without mixing old ink that the quality is reduced due contact with air.

Furthermore, since no ink remains in the ink cartridge, at the time of recycling of the ink cartridge, there is no need to internally clean the container body 1 or very simple cleaning is sufficient. For example, when an empty ink cartridge is to be cleaned, it may be lightly cleaned by a cleaning liquid having higher affinity with the inner wall of the ink cartridge and the actuator 106 than that of ink contained in the container body 1. More in detail, when the ink cartridge uses aqueous ink, it may be lightly cleaned by an oily cleaning liquid having higher affinity with the inside of the ink cartridge. Therefore, the cleaning time at the time of recycling of the ink cartridge can be shortened. Therefore, the cost of recycling of the ink cartridge is reduced.

There is no special restriction on the selection of a cleaning liquid as long as the cleaning liquid is more lyophilic than ink. A cleaning liquid which is more lyophobic than ink can be more accustomed to the inner wall of the ink cartridge and the actuator 106. Therefore, impurities remaining in the ink cartridge can be washed away simply.

To leave no ink in the cavity 162, it is possible to make the cavity 162 internally inkphobic and make the substrate back 178*a* around the cavity 162 lyophilic (inkphilic).

The lyophilic nature means the affinity with an optional liquid and includes hydrophilic nature, oilphilic nature, ultrahydrophilic nature, and ultra-oilphilic nature. The contact angle of a liquid to the lyophilic part is about 30 degrees or less and it is preferable that the contact angle is closer to 0 degrees.

Furthermore, to leave no ink in the through hole 1*c*, it is possible to make the inside of the cavity 162, the substrate back 178*a*, and the inner wall of the through hole 1*c* inkphobic and make the inner side 1*d* of the circumference of the through hole 1*c* inkphilic. Thereby, ink in the cavity 162 and the through hole 1*c* hardly remains in the cavity 162 and the through hole 1*c* and easily flows under the container body 1 by passing the substrate back 178*a* and the inner side 1*d*. Even if ink is adhered to the actuator 106 and its circumference, ink flows down without staying.

When a liquid in the liquid container does not remain in the cavity 162, as compared with a case that ink in the cavity 162 or the through hole 1*c* remains, at least changes in the acoustic impedance which are detected by the actuator 106 are remarkable. Therefore, the actuator 106 can detect the existence of ink in the ink cartridge more remarkably and precisely.

Meanwhile, when the cavity 162 or the through hole 1*c* is internally made inkphobic, thus the ink cartridge is to be charged with ink, it is difficult to charge the cavity 162 or the through hole 1*c* with ink.

However, according to this embodiment, as mentioned above, when the container body 1 is to be charged with ink at the time of manufacturing of an ink cartridge or when the ink cartridge is to be reused, the ink cartridge is set to negative pressure by evacuation and the ink cartridge is charged or recharged with ink using the negative pressure. As a result, although the cavity 162 and the through hole 1*c* are inkphobic, they are able to be filled with ink.

Figure 17B:
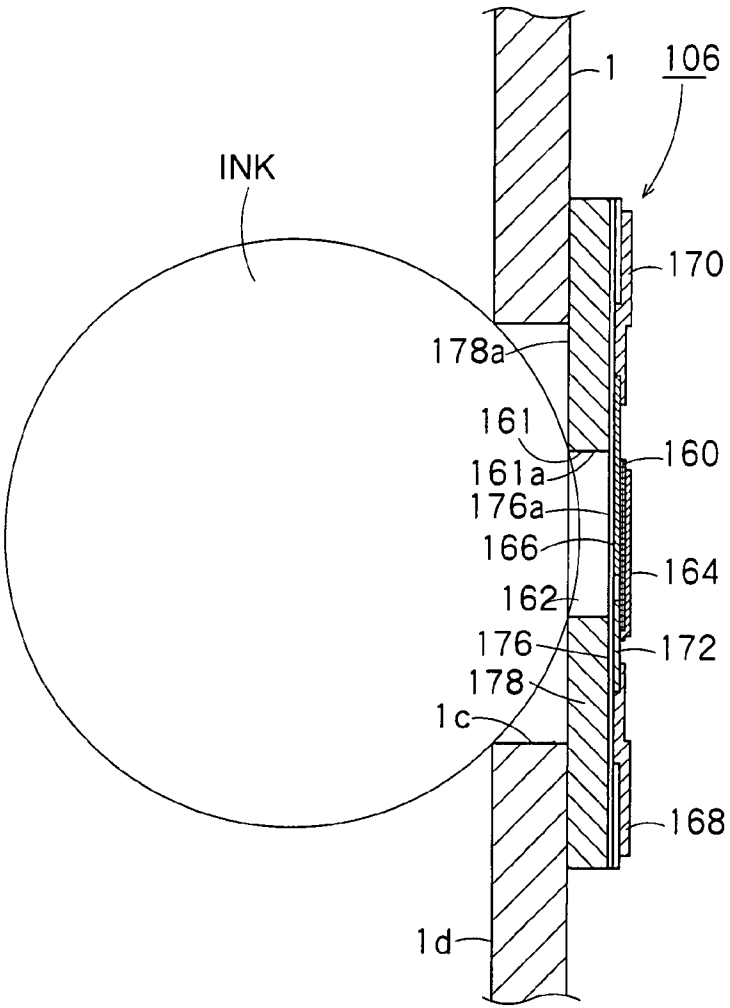
FIGS. 17A and 17B are sectional views of the part of the actuator shown in FIGS. 2A, 2B and 2C which is attached to the side wall of the container body and enlarged.
Figure 17A:
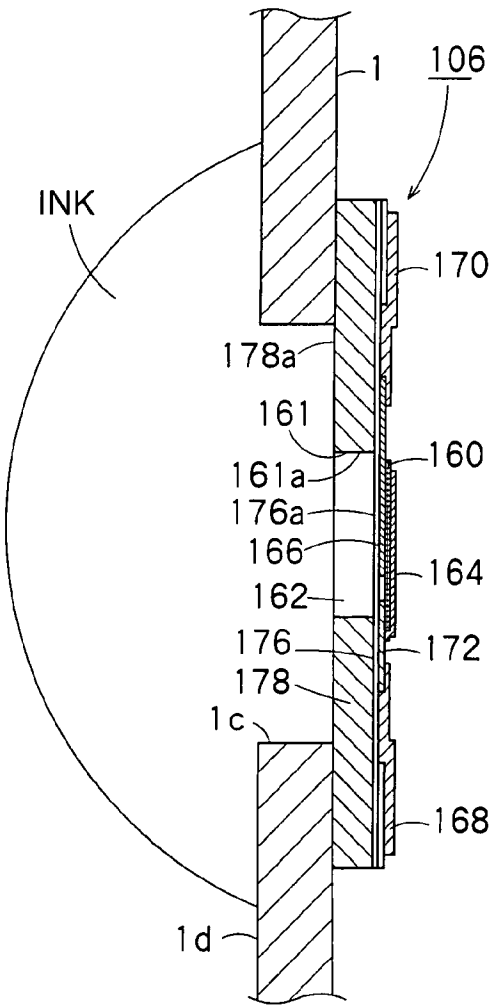

FIGS. 17A and 17B are sectional views of the part of the actuator 106 attached to the side wall of the container body 1 which is enlarged. An ink drop which is apt to adhere to the actuator 106 by mistake after the ink level passes the actuator 106 is also shown in the drawing.

FIG. 17A is a drawing showing a comparison example. The through hole 1*c* and the cavity 162 are not inkphobic, so that ink drops adhere to the actuator 106 and the through hole 1*c* and stay there. Therefore, there is the possibility that the actuator 106 may detect by mistake that there is ink in the ink cartridge though there is no ink in the same.

FIG. 17B is a drawing showing this embodiment. When the through hole 1*c* and the cavity 162 are made inkphobic, ink drops cannot adhere to the actuator 106 and fall downward with an almost spherical shape kept by surface tension. Therefore, the actuator 106 will not detect the existence of ink in the ink cartridge by mistake.

Next, a lyophobic material will be explained. A lyophobic material for forming a lyophobic part is not limited particularly. Therefore, an optional lyophobic material can be used. As a strongly lyophobic material, a material including fluorine resin (fluoroalkyl compound) and silicone resin are general. For example, fluoroolefin and fluorine resin having the perfluoro group are stable thermally and chemically and superior in water resistance, chemical resistance, solvent resistance, releasability, abrasion resistance, and water repellency. Silicone resin is superior in water repellency and oil repellency. However, the composition of paint is often structured by combination with another resin such as acrylic resin, epoxy resin, or urethane resin or modification so as to keep the hardness.

More in detail, the materials to be used are a lacquer type fluorine resin material, a fluorine ultraviolet-curing material, a thermoset fluorine resin material, a fluorine silane coupling agent, an epoxy resin composition with fluorine resin particles dispersed, a fluorine epoxy resin composition, fluorine diol, and polytetrafluoroethylene (PTFE).

The materials to be used are also a silane coupling agent, a silicone surface-active agent, silicone rubber, petrolatum, hydroxyl group silicon, chemicals using two-component system of silicon and acrylic resin, ethyl silicate, N-butyl silicate, N-propyl silicate, chlorosilane, alkoxysilane, and silazine.

Furthermore, the materials to be used may be chemicals using epoxy resin, cationic polymerization catalyst, digrime, PP, PE, PA, PET, PBT, PSF, PES, PEEK, PEI, OPP, PVC, maleic petroleum resin alkali salt, paraffin wax, and photocatalyst.

A method for covering the surface of a predetermined material with a lyophobic material is not particularly limited. Therefore, an optional method for covering a lyophobic material can be used. As a method for covering a lyophobic material, for example, there are plating, coating, film adhesion, and deposition available. A lyophobic material may be coated using any other known optional arts. For example, in the method by coating, a lyophobic material may be coated by spin coat of dropping a lyophobic liquid before or during rotation of a lyophobic part and coating by rotating the lyophobic part, or dip coat of immersing and coating the lyophobic part in a lyophobic liquid, or roll coat of coating a lyophobic liquid on a lyophilic part by rolling. Further, a lyophilic liquid may be coated on a lyophobic part just by a brush. Further, a lyophobic part may be formed by adhering a coating layer composed of a lyophobic material at a predetermined part. Further, as a method by deposition, there are Chemical Vapor Deposition (CVD), plasma CVD, sputtering, and vacuum vapor deposition available.

The degree of roughness of the surface of a material may affect the water repellency. For example, when a material having a contact angle of 90 degrees or more is subjected to the roughening process, the lyophobic property is improved.

Further, for example, when the material is a lyophobic material having a fractal structure, if the degree of roughness of the surface is increased, the surface becomes super water repellent or super oil repellent. Therefore, a lyophobic part may be formed by performing the roughening process for the surface of a lyophobic material having a fractal structure. However, if a material becomes lyophobic by the roughening process, it is not limited to a material having a fractal structure.

As a manufacturing method for an ink cartridge having a lyophobic part in this embodiment, the following methods may be cited.

The first method installs the actuator 106 shown in FIGS. 2A, 2B and 2C to a predetermined tool or masks it so as to expose the cavity 162. The predetermined tool is attached to the device for forming a lyophobic part and the cavity 162 is internally made lyophobic. Thereafter, the actuator 106 is attached to the module body 100 and the module body 100 is attached to the ink cartridge. The predetermined tool is formed from a plastic or metallic material having a hole in the part of the cavity 162. The part other than the cavity 162 may be masked using thermoplastic resin.

By this method, a lyophobic part can be formed only on the actuator 106. Further, since the lyophobic part is formed before the actuator 106 is attached to the module body 100, only the actuator 106 should be handled so as to form a lyophobic part. Therefore, the manufacturing equipment for ink cartridges can be made comparatively small. By doing this, the cost for manufacturing the same ink cartridges can be reduced.

The second method mounts the actuator 106 shown in FIGS. 2A, 2B and 2C to the module body 100 first. Thereafter, the second method installs the actuator 106 to a predetermined tool or masks it so as to expose the cavity 162. The predetermined tool is attached to the device for forming a lyophobic part and the inside of the actuator 106 or the inside of the cavity 106 and the module body 100 around it are made lyophobic. Thereafter, the module body 100 is attached to the ink cartridge.

By this method, the part of the module body 100 around the actuator 106 is subjected to the process of making the same lyophobic simultaneously with the inside of the cavity 162, thus the inside of the cavity 162 and the module body 100 around it can be made lyophobic.

The third method mounts the actuator 106 shown in FIGS. 2A, 2B and 2C to the module body 100 first and attaches the module body 100 to the ink cartridge. Thereafter, the second method installs the actuator 106 to a predetermined tool or masks it so as to expose the cavity 162. The predetermined tool is attached to the device for forming a lyophobic part and the inside of the actuator 106 or the inside of the cavity 106 and the module body 100 around it are made lyophobic.

By this method, the actuator 106, the module body 100, and the inside of the ink cartridge are subjected to the process of making them lyophobic at the same time, thus the inside of the cavity 162, the module body 100 around it, and moreover the inside of the ink cartridge can be made lyophobic.

With respect to the module body 100, the part in contact with ink may be made lyophobic.

Figure 18:
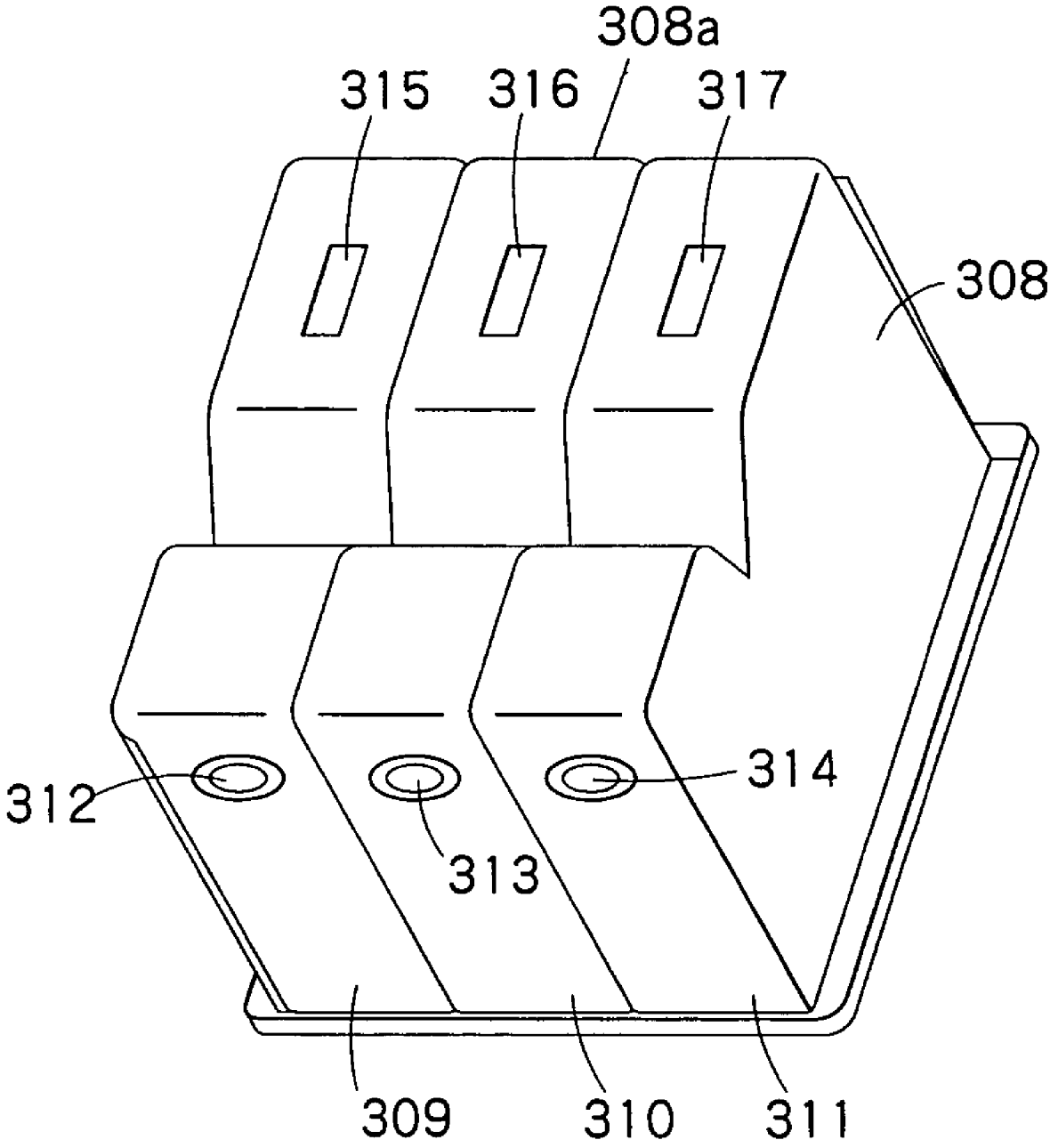
FIG. 18 is a perspective view, viewed from the back, showing an ink cartridge for containing a plurality of kinds of ink which is an embodiment of the liquid container of the present invention.

FIG. 18 is a perspective view, viewed from the back, showing an example of ink cartridges for containing a plurality of kinds of ink. A container 308 is divided into three ink chambers 309, 310, and 311 by partitions. In the respective ink chambers, ink feed ports 312, 313, and 314 are formed. To a bottom 308*a* of the respective ink chambers 309, 310, and 311, actuators 315, 316, and 317 are attached so as to transfer an elastic wave to ink contained in the respective ink chambers via the container 308. The inside of the container 308 of the ink cartridges and the actuators 315, 316, and 317 in this example are also lyophobic respectively. The inner walls of the respective ink chambers 309, 310, and 311 may be formed so as to be inkphobic.

The present invention is explained above using the embodiments. However, the technical scope of the present invention is not limited to the scope described in the embodiments aforementioned. Various changes and improvements can be added to the embodiments aforementioned. The text described in the claims of the patent shows that such changes and improvements are included in the scope of the present invention.

According to the present invention, a liquid container can be charged with a liquid without leaving air bubbles inside the liquid container having a piezo-electric device by which the consumption condition of liquid can be detected precisely and no complicated seal structure is needed.

Further, even when a used liquid container is to be reused, a liquid can be recharged without leaving air bubbles inside the used liquid container.

Furthermore, even when a liquid container internally having a lyophobic part is to be used, a liquid can be charged without leaving air bubbles inside the liquid container.

What is claimed is:

1. A method of manufacturing a liquid container, the method comprising:

providing a liquid container comprising:

a liquid containing chamber configured to contain a liquid;

a liquid feed port adapted to supply the liquid contained in the liquid containing chamber to an outside;

an air inlet configured to introduce air into the liquid containing chamber according to consumption of the liquid contained in the liquid containing chamber; and a piezo-electric device configured to detect a consumption condition of the liquid contained in the liquid containing chamber, wherein the liquid containing chamber includes a first containing chamber communicating with the liquid feed port, a second containing chamber communicating with the first containing chamber, and a buffer communicating with the second containing chamber and configured to catch air;

reducing a pressure in the liquid containing chamber; and charging the liquid containing chamber, excluding the buffer, with liquid having an amount corresponding to a capacity of the first and second containing chambers through an opening formed in the buffer.

2. The method of claim 1, further comprising forming the opening in the buffer.

* * * * *